US008183702B2

(12) United States Patent
Hiranuma et al.

(10) Patent No.: US 8,183,702 B2
(45) Date of Patent: May 22, 2012

(54) ENGINE GENERATOR

(75) Inventors: Junji Hiranuma, Wako (JP); Masanori Shin, Wako (JP); Hitoshi Yuki, Wako (JP); Ryosuke Shibata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 389 days.

(21) Appl. No.: 12/485,358

(22) Filed: Jun. 16, 2009

(65) Prior Publication Data

US 2009/0322100 A1 Dec. 31, 2009

(30) Foreign Application Priority Data

Jun. 27, 2008 (JP) ..... 2008-168512
Jun. 27, 2008 (JP) ..... 2008-168562

(51) Int. Cl.
*F02B 63/04* (2006.01)

(52) U.S. Cl. ..... 290/1 A

(58) Field of Classification Search ..... 290/1 A, 290/1 B, 10; 123/41.6, 41.57, 41.31, 198 E, 123/41.65, 2; 280/47.371; 307/68
See application file for complete search history.

(56) References Cited

U.S. PATENT DOCUMENTS

| | | | | |
|---|---|---|---|---|
| 5,642,702 | A * | 7/1997 | Kouchi et al. | 123/198 E |
| 7,673,589 | B2 * | 3/2010 | Shimada et al. | 123/2 |
| 2005/0029815 | A1 | 2/2005 | Brandenburg et al. | |
| 2005/0264014 | A1 * | 12/2005 | Brandenburg et al. | 290/1 A |
| 2007/0108767 | A1 * | 5/2007 | Hirose et al. | 290/1 A |
| 2008/0202447 | A1 * | 8/2008 | Kochi et al. | 123/2 |
| 2009/0315286 | A1 * | 12/2009 | Takemura | 280/47.34 |
| 2011/0057401 | A1 * | 3/2011 | Okabe | 280/47.17 |
| 2011/0095540 | A1 * | 4/2011 | Jackson et al. | 290/1 A |

FOREIGN PATENT DOCUMENTS

| | | | |
|---|---|---|---|
| EP | 976967 | A1 | 2/2000 |
| JP | 10-147244 | A | 6/1998 |
| JP | 2005-076550 | A | 3/2005 |
| TW | 262144 | B | 9/2006 |

OTHER PUBLICATIONS

Russian Office Action dated Oct. 5, 2010, issued in corresponding Russian Patent Application No. 2009124121/06.
European Search Report dated Sep. 29, 2009, issued in corresponding European Patent Application No. 09163631.
Notification of Reasons for Refusal dated Dec. 13, 2011, issued in corresponding Japanese Patent Application No. 2008168512 with a partial English language translation.
Notification of Reasons for Refusal dated Dec. 13, 2011, issued in corresponding Japanese Patent Application No. 2008168562 with a partial English language translation.

* cited by examiner

*Primary Examiner* — Julio C. Gonzalez
(74) *Attorney, Agent, or Firm* — Westerman, Hattori, Daniels & Adrian, LLP

(57) ABSTRACT

An engine generator accommodating an engine and a generator inside a case. A first stationary handle that extends in the width direction is mounted in the rear section of the case. A second stationary handle is mounted on the upper front part of the case. A draw handle is provided so as to swing in the vertical direction in relation to the second stationary handle. The second stationary handle is manually grasped and the engine generator is moved. The first and second stationary handles are grasped and the engine generator is lifted. The draw handle is pulled to move the engine generator.

7 Claims, 15 Drawing Sheets

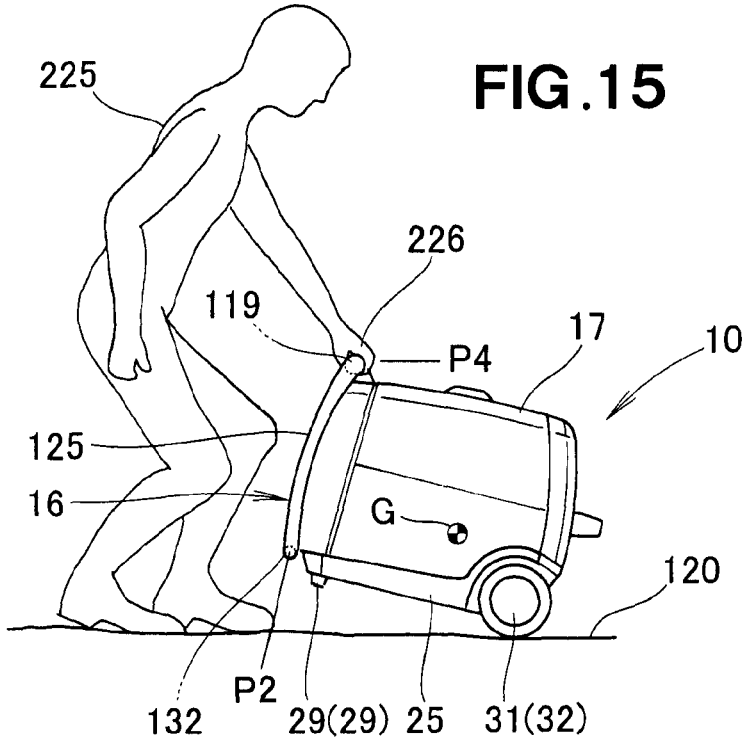
FIG.15
FIG.16
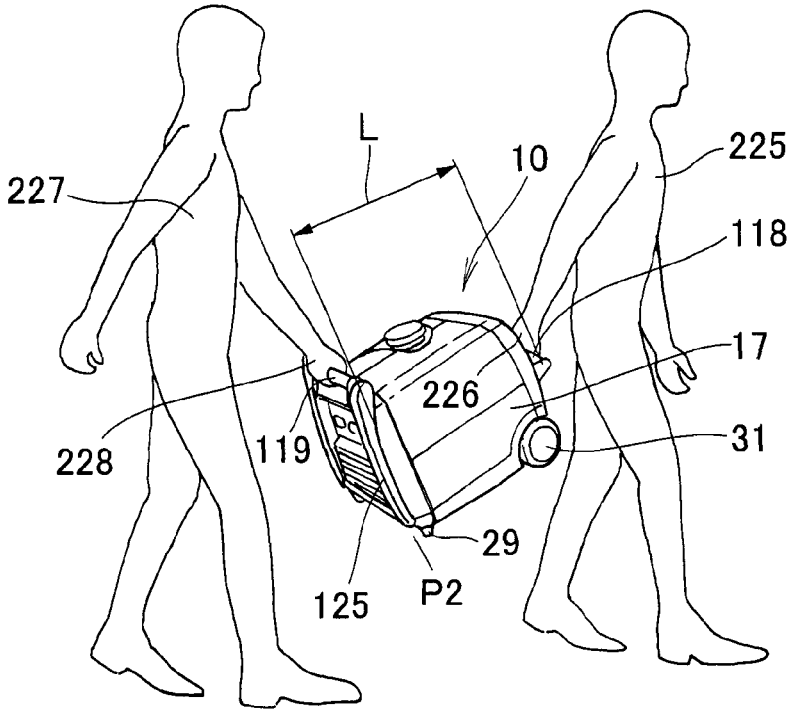

ENGINE GENERATOR

FIELD OF THE INVENTION

The present invention relates to an engine generator having wheels, wherein an engine and a generator are accommodated in a case.

BACKGROUND OF THE INVENTION

There are known in the art engine generators in which wheels and leg sections are provided to a bottom cover, an engine and a generator are accommodated in a case, and a handle for transport is provided to the upper side of the case and to the opposite side of the wheels, such as the engine generator disclosed by way of example in Japanese Patent Application Laid-Open Publication No. 2005-76550. A transport handle used for transporting the engine generator extends from left and right end sections of the case substantially horizontal to the direction in which the handle lever separates from the case, and grips are provided to the distal ends of the left and right handle levers.

In the above engine generator, pushing the transport handle in a state where the left and right grips have been gripped and lifted up so as to lift the support legs above the road surface causes the wheels to rotate and allows the engine generator to be moved and transported.

The only method for transporting the engine generator involves lifting the left and right grips and pushing the transport handle.

However, various transport methods such as pulling and lifting are required when one desires to transport the engine generator. Accordingly, the engine generator described above is not compatible with a variety of transport methods, and there has been a need to increase the ability of such engine generators to be transported.

SUMMARY OF THE INVENTION

An object of the present invention is to provide an engine generator that can be transported using various transport methods and made easier to transport.

According to the present invention, there is provided an engine generator which comprises: a bottom cover provided with left and right wheels via a shaft; an engine disposed on the bottom cover; a generator disposed on the bottom cover and driven by the engine; a case for accommodating the engine and the generator jointly with the bottom cover; a first stationary handle provided on one side in a front-and-rear direction of the case above the left and right wheels and extending parallel to the shaft; a second stationary handle provided on an opposite side in the front-and-rear direction of the case and extending parallel to the shaft; and a draw handle provided externally of the case so as to swing vertically relative to the second stationary handle.

The inventive arrangement thus includes the first stationary handle provided to one side of the case in the longitudinal direction and the second stationary handle provided to the upper side of the case and to the other side of the case in the longitudinal direction. Accordingly, the first stationary handle and the second stationary handle can be disposed with a large space provided therebetween. Thus, when one person manually grips the first stationary handle and another person manually grips the second stationary handle, the two people will not come into contact with one another. Therefore, the engine-driven generator can be lifted and transported by two people and made easier to transport.

When one person grasps and lifts the second stationary handle, only the left and right wheels will remain in a state of contact with the road surface. Accordingly, one person can move the engine generator by causing the wheels to rotate while pushing the second stationary handle. Causing the left and right wheels to rotate and transporting the engine generator makes it possible to accurately move the position of the engine generator. As a result, the engine generator can be readily positioned for storage when it is to be stored away.

Preferably, the draw handle comprises: a support shaft coaxially provided inside the second stationary handle; left and right pivot arms swingably provided in the vertical direction to the support shaft; and a movable handle provided so as to extend between the left and right pivot arms. Accordingly, a movable handle can be disposed in a position set at a distance from the support shaft, i.e., a position set apart from the wheels. As a result, when the person grasps the movable handle and lifts the movable handle about the shaft to a position for actual transport while facing away from the engine generator, the lifting force can be reduced, transporting the generator can be facilitated, and the generator can be moved while the movable handle is pulled using a single hand.

As described above, there are provided in the present invention the first stationary handle, the second stationary handle, and the movable handle, whereby each of the handles can be used to transport the engine generator. Various transport methods can thereby be selected and the engine generator can be more readily transported.

Desirably, the engine generator is provided with a skeletal member which includes the bottom cover, a wall-shaped vertical frame, and a center frame. The vertical frame may be erectly disposed in the vicinity of the end part of the bottom cover on the side opposite from the position of the left and right wheels. The center frame may be provided to extend between the vertical frame and the end part of the bottom cover on the side where the left and right wheels are positioned. The first stationary handle may be mounted via left and right handle mounting sections provided to the bottom cover. The second stationary handle may be mounted on the vertical frame.

The bottom cover can thus be made sufficiently rigid because the skeletal member is formed by the bottom cover, the vertical frame, and the center frame. The bottom cover is provided with the left and right handle mounting sections and the first stationary handle is provided to the left and right handle support sections. The first stationary handle can thereby be securely mounted on the left and right handle support sections.

The vertical frame is provided with the second stationary handle and the movable handle. The vertical frame is a member for forming the skeletal member, and the rigidity of the vertical frame is sufficiently assured. The second stationary handle and the movable handle can be securely mounted on the vertical frame by providing the second stationary handle and the movable handle to the highly rigid vertical frame.

It is preferred that the draw handle further include a structure for positioning the movable handle in a transport position, and that the movable handle be positioned in the positioning structure so that the center of gravity of the engine generator is positioned in the vicinity of tilt lines that extend from the movable handle to the left and right wheels. Therefore, the engine generator is less liable to tilt or roll over to the left or right than when the center of gravity of the engine generator is disposed above the tilt lines. The engine generator can thereby be stably transported, even on ground that is not level or other such surfaces.

It is preferred that the second stationary handle cover the support shaft and be coaxial therewith. Therefore, the second stationary handle is reinforced by the support shaft. As a result, the weight of the engine generator can be reduced because the structure of the second stationary handle can be simplified while assuring the rigidity of the second stationary handle. The person can grasp the second stationary handle with both hands while facing the engine generator, and lift the engine generator to a transport position.

It is preferred that the bottom cover have leg sections on the two corner sections in positions on the side opposite from the positions of the left and right wheels respectively. The second stationary handle and the movable handle are provided to the leg section side. Accordingly, the center of gravity of the engine generator can be set at a distance from the second stationary handle and the movable handle. The second stationary handle and the movable handle can be lifted to a transport position with a relatively low amount of force, and the engine generator can be readily moved.

It is preferred that the positioning structure have a restricting section for positioning the movable handle in the transport position, the restricting section being provided in a location for supporting the support shaft; and have a stopper section that can make contact with the restricting section, the stopper section being provided to the support shaft. It is also preferred that the stopper section make contact with the restricting section, whereby the movable handle is positioned in the transport position. The upper section side of the case is a location for supporting the support shaft and is formed so as to have higher rigidity. Providing the restricting member to the upper section side of the highly rigid case thus makes it possible for the stopper section to be reliably positioned in a transport position when the stopper section makes contact with the restricting section. Therefore, the engine generator can be readily moved because the movable handle can be reliably positioned in the transport position and the leg sections can be reliably lifted from the road surface using the movable handle.

It is preferred that the left and right pivot arms and the movable handle be formed from a fiber-reinforced plastic material. As a result, the left and right pivot arms and the movable handle will be reliably rigid, and each member can be thinner. In turn, the weight of the engine generator can be reduced and the engine generator can be readily transported. Furthermore, the draw handle becomes easier to use, and the reduced weight of the left and right pivot arms and the movable handle increase convenience.

BRIEF DESCRIPTION OF THE DRAWINGS

A preferred embodiment of the present invention will be described in detail below, by way of example only, with reference to the accompanying drawings, in which:

FIG. 15 shows an example of the stationary handle being grasped and the engine generator being lifted and moved;

FIG. 16 shows an example of two people carrying the engine generator; and

DETAILED DESCRIPTION OF THE PREFERRED EMBODIMENT

The term "forward direction" used herein is meant to be the direction in which an engine generator 10 according to the present invention is pulled by a draw handle 125.

Figure 1:
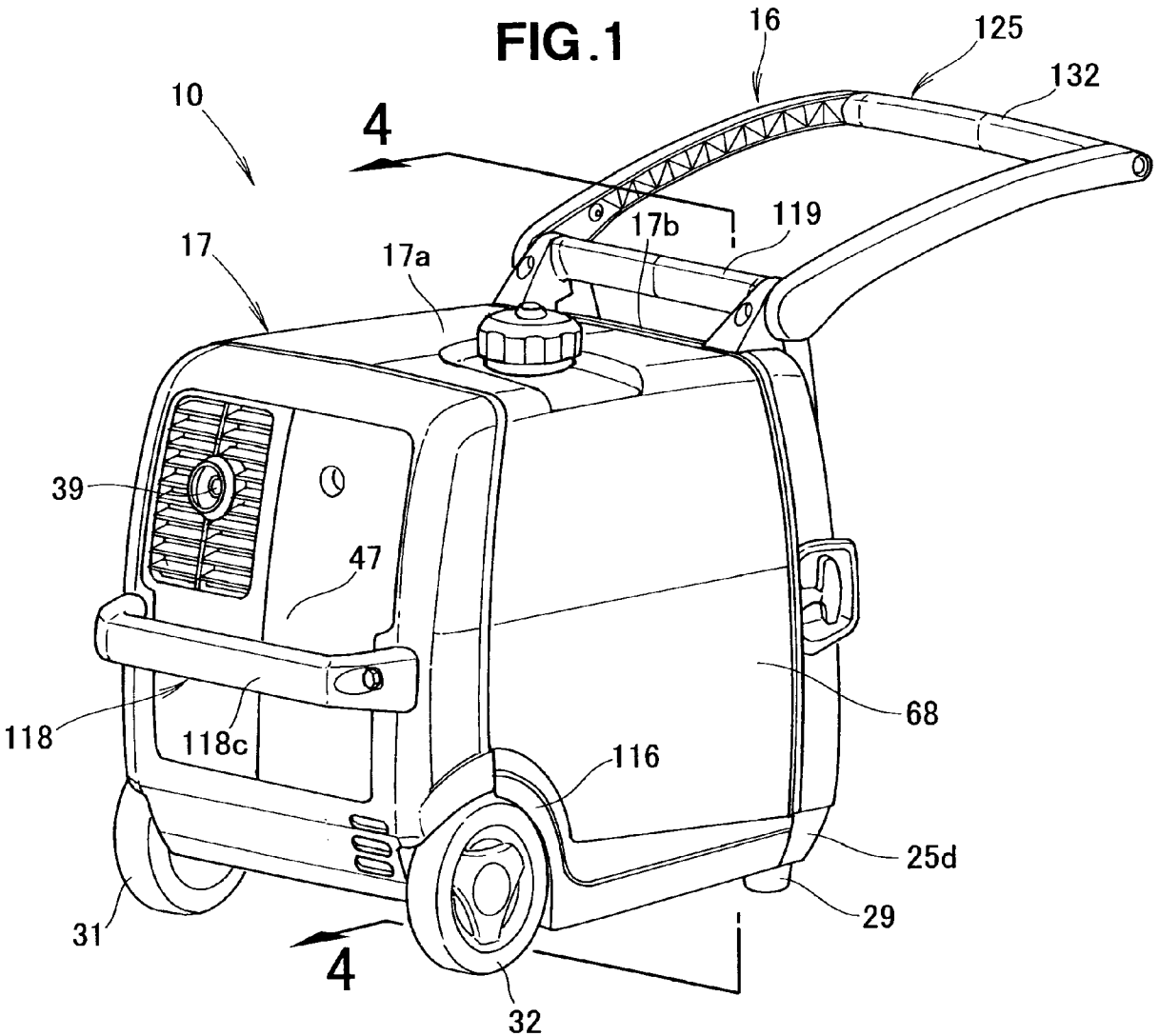
FIG. 1 is a perspective view showing an engine generator according to an embodiment of the present invention.
Figure 2:
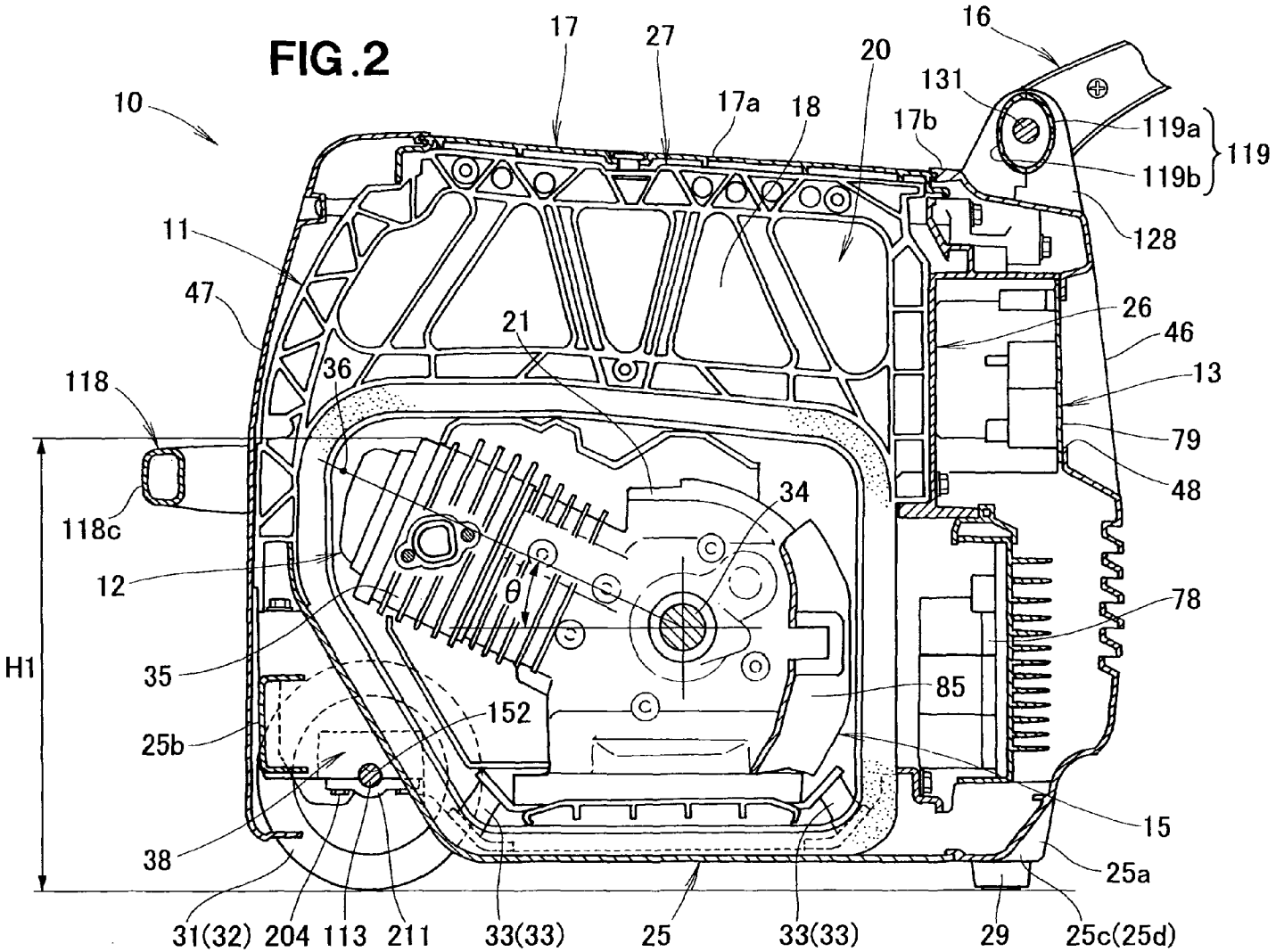
FIG. 2 is a cross-sectional view taken longitudinally of the engine generator of FIG. 1.

In FIGS. 1 and 2, the engine generator 10 includes a skeletal member 11 that forms a main skeletal body, an engine/generator unit 12 provided to the skeletal member 11, and an electrical component section 13 for controlling the output of the engine/generator unit 12, an intake/fuel feed mechanism 14 (see FIG. 4) for feeding fuel to the engine/generator unit 12, a cooling structure 15 for directing cooling air to the engine/generator unit 12, a transport structure 16 for transporting the engine generator 10, a case 17 for covering the engine/generator unit 12 and the electrical component section 13, an insulating material 18 for partitioning accommodation space 20 inside the case 17, and a muffler 23 (see FIG. 4) provided to an engine 21 of the engine/generator unit 12.

The engine generator 10 has left and right leg sections 29 provided to left and right corner sections 25*c*, 25*d* of a front-end part 25*a* of a bottom cover 25 constituting the bottom section of the skeletal member 11, and left and right wheels (transport wheels) 31, 32 provided to a rear-end part 25*b*. The left and right corner sections 25*c*, 25*d* are two corner sections positioned towards the front, which is the side opposite from the left and right wheels 31, 32. The left and right leg sections 29 are each formed using a rubber member.

The bottom cover 25 is essentially horizontal in a state in which the left and right leg sections 29 and the left and right wheels 31, 32 are in contact with the ground. The engine generator 10 is thereby used in a stable orientation.

In the engine generator 10, the engine/generator unit 12 is mounted on the bottom cover 25 of the skeletal member 11 via four mounting members (mount members) 33. The engine 21 and a generator 22 (see FIG. 4) driven by the engine 21 are integrally provided to the engine/generator unit 12.

Figure 4:
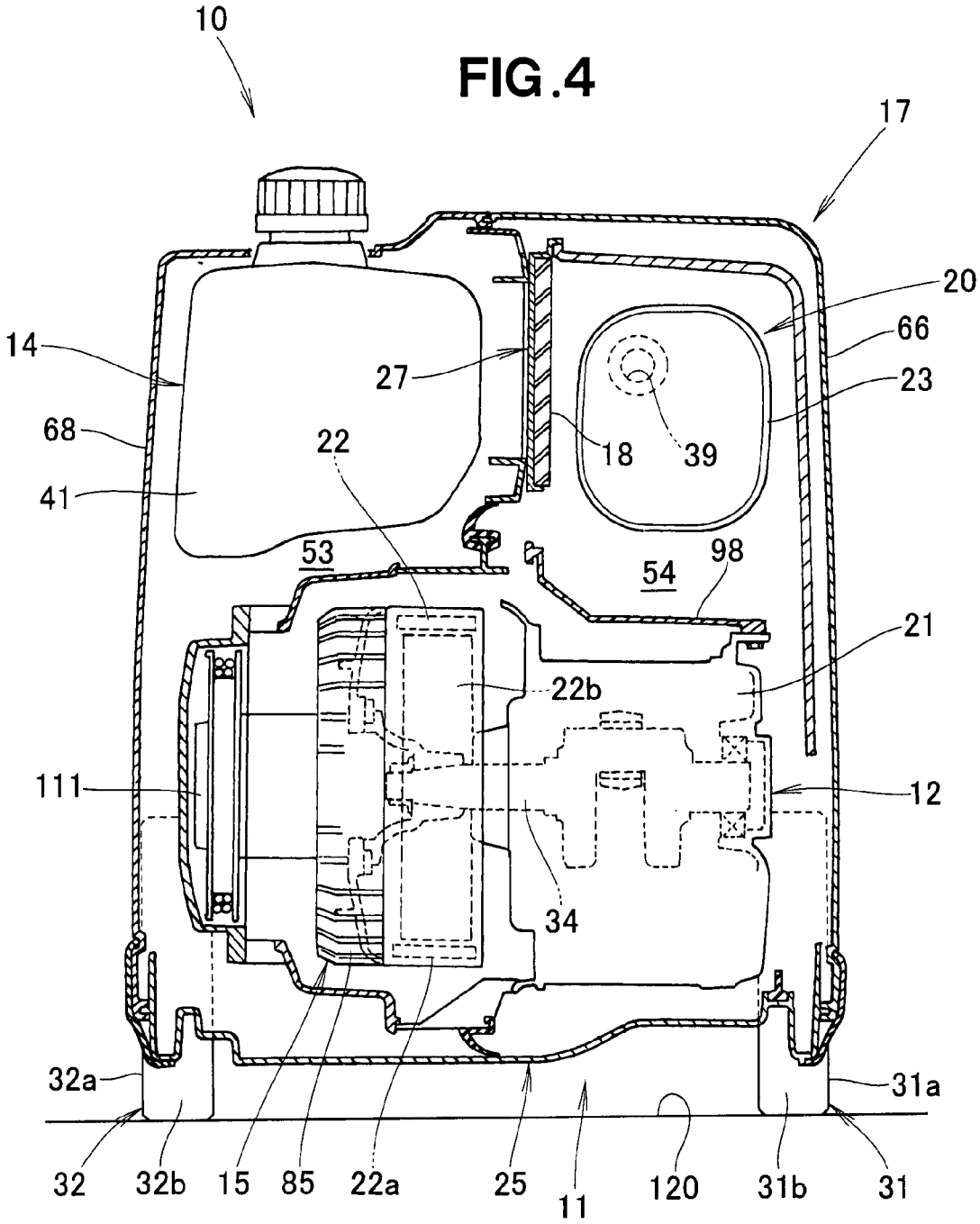
FIG. 4 is a cross-sectional view taken along line 4-4 of FIG. 1.

The generator 22 is coaxially provided to a drive shaft (crankshaft) 34 of the engine 21 (see FIG. 4). A cylinder block 35 of the engine 21 is inclined at an angle of θ° to the left and right wheels 31, 32 (i.e., the direction of the shaft 113 for supporting the left and right wheels 31, 32) using the drive shaft 34 as a support point. Inclining the cylinder block 35 of the engine 21 at angle θ enables the height H1 of the engine 21 to be reduced, the height of the engine generator 10 to be reduced, and the engine generator 10 to be made more compact. Reference numeral 36 shown in FIG. 2 shows the center of the cylinder in the cylinder block 35.

Adequate wheel accommodation space 38 can be provided below the cylinder block 35 in a state in which the cylinder block 35 of the engine 21 is inclined at the angle θ. The left and right wheels 31, 32 are disposed in the wheel accommodation space 38. The engine generator 10 can be made even more compact by having the left and right wheels 31, 32 disposed in the wheel accommodation space 38.

Figure 14:
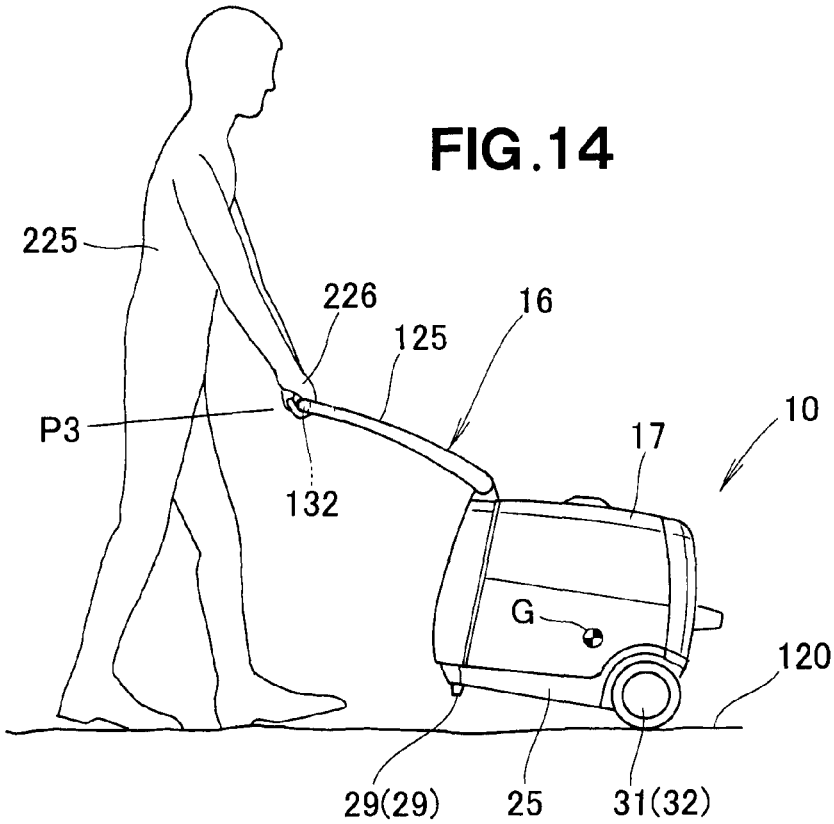
FIG. 14 shows an example of the movable handle being grasped using both hands and the engine generator being pushed and transported.

Inclining the cylinder block 35 at an angle θ in the direction of the left and right wheels 31, 32 allows the center of gravity G (see FIG. 9) of the engine generator 10 to be brought closer to the left and right wheels 31, 32 in a state in which the left and right leg sections 29 and the left and right wheels 31, 32 are in contact with the ground. Specifically, the center of gravity G of the engine generator 10 is brought closer to the left and right wheels 31, 32 and set between the left and right leg sections 29 and the left and right wheels 31, 32. The reason for bringing the center of gravity G of the 10 closer to the left and right wheels 31, 32 is illustrated in FIGS. 12, 14, and 15.

Figure 3:
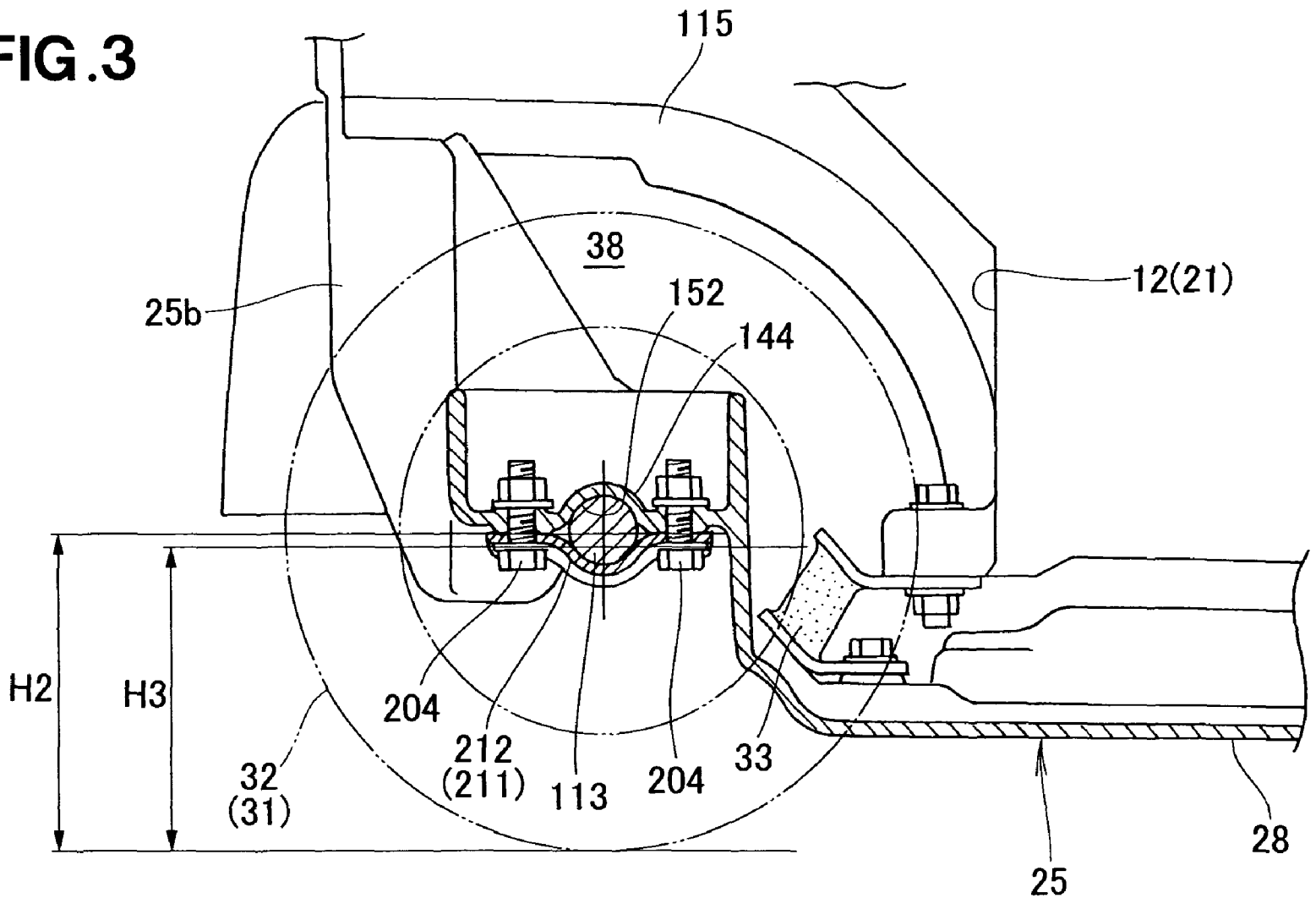
FIG. 3 is a cross-sectional view showing details of the mounting of a shaft on a bottom cover of FIG. 2.

A shaft lateral rib 144 integrally formed in the vicinity of the rear-end part 25*b* of the bottom cover 25 extends in the left/right direction, as shown in FIG. 3. The shaft lateral rib 144 is a reinforcement section that bulges upward to form an inverted U-shape in cross-section. An accommodation recess 152 for accommodating the shaft 113 is provided to a bottom surface 28 of the bottom cover 25 by having the shaft lateral rib 144 formed in an inverted U-shape in cross section. The shaft 113 is arranged in the left/right direction parallel to the drive shaft 34 (FIG. 4) of the engine 21.

The shaft 113 is supported by left and right support bearings 211, 212 in a state in which the shaft 113 is accommodated in the accommodation recess 152. The left and right support bearings 211, 212 are mounted on the bottom surface 28 of the bottom cover 25 using a plurality of bolts 204. The left and right wheels 31, 32 are rotatably mounted on the left and right end sections, respectively, of the shaft 113.

The left and right wheels 31, 32 are disposed in the wheel accommodation space 38 by ensuring the wheel accommodation space 38 is provided below the cylinder block 35 of the engine 21, as shown in FIG. 2. Accordingly, the left and right wheels 31, 32 can be upwardly disposed (i.e., in a high position). The shaft 113 disposed below the cylinder block 35 can be disposed above a plurality of mounting members 33 for mounting the engine/generator unit 12, as shown in FIG. 3. Specifically, the height H2 of the shaft 113 is set to be greater than the height H3 of the mounting members 33.

Arranging the left and right wheels 31, 32 in the wheel accommodation space 38 thus enables the left and right wheels 31, 32 to be upwardly disposed (a high position). The engine generator 10 can thereby be made even more compact.

The engine/generator unit 12 is mounted on the bottom cover 25 in a state in which the drive shaft 34 of the engine 21 is laterally disposed facing the left/right direction, as shown in FIG. 4. The driving of the engine 21 In the engine/generator unit 12 causes the drive shaft 34 to rotate. The rotation of the drive shaft 34 is transmitted to a cooling fan 85 and the cooling fan 85 rotates. The rotation of the cooling fan 85 causes a rotor 22*a* of the generator 22 to rotate along the external periphery of a stator 22*b*. The rotation of the rotor 22*a* causes the generator 22 to generate power.

The muffler 23 is provided above the engine 21 of the engine/generator unit 12. The muffler 23 discharges from an exhaust port 39 exhaust gas from the cylinder block 35 (FIG. 2) of the engine 21. A fuel tank 41 of the intake/fuel feed mechanism 14 is provided above the generator 22 of the engine/generator unit 12.

The engine/generator unit 12, the muffler 23, and the fuel tank 41 are accommodated inside the case 17, which is formed to be substantially U-shaped in cross section. The case 17 is formed from polypropylene (PP) or another resin, and disposed above the bottom cover 25. Having the case 17 provided above the bottom cover 25 allows an accommodation space 20 to be formed by the case 17 and the bottom cover 25.

The case 17 has left and right side wall sections 66, 68. The left wheel 31 is disposed toward the center in the transverse direction of the case 17 with respect to the left-side wall section 66. Specifically, the left wheel 31 is disposed inside (i.e., toward the center in the transverse direction of the case 17) the left-side wall section 66 so that an outside surface 31a does not protrude beyond the left-side wall section 66.

The right wheel 32 is disposed toward the center in the transverse direction of the case 17 with respect to the right-side wall section 68. Specifically, the right wheel 32 is disposed inside (i.e., toward the center in the transverse direction of the case 17) the right-side wall section 68 so that an outside surface 32*a* does not protrude beyond the right-side wall section 68.

The cooling structure 15 cools an inverter unit 78 (FIG. 2) of the electrical component section 13, the engine 21, the muffler 23, and the like.

The electrical component section 13 controls the output of the engine/generator unit 12. The electrical component section 13 is provided with a control panel 79 in the upper half section, and with the inverter unit 78 in the lower half section, as shown in FIG. 2. A switch for starting the engine, and an AC terminal, a DC terminal, or the like for outputting generated power, are provided to the control panel 79 so as to face outward from an opening 48 in the front case section 46. The inverter unit 78 controls the output frequency of the generator 22.

Figure 5:
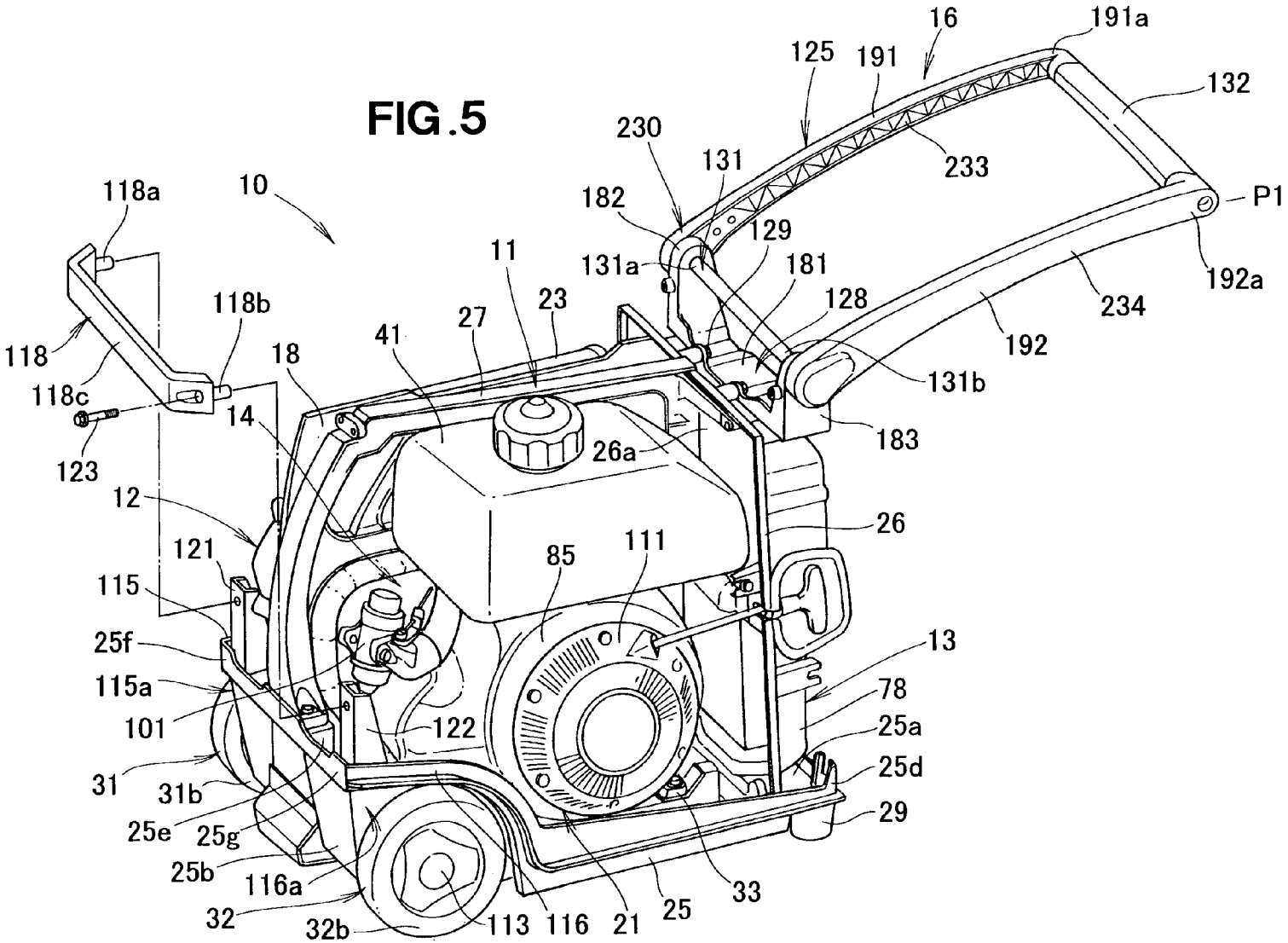
FIG. 5 is a perspective view showing the engine generator of FIG. 1, with a case removed.
Figure 6:
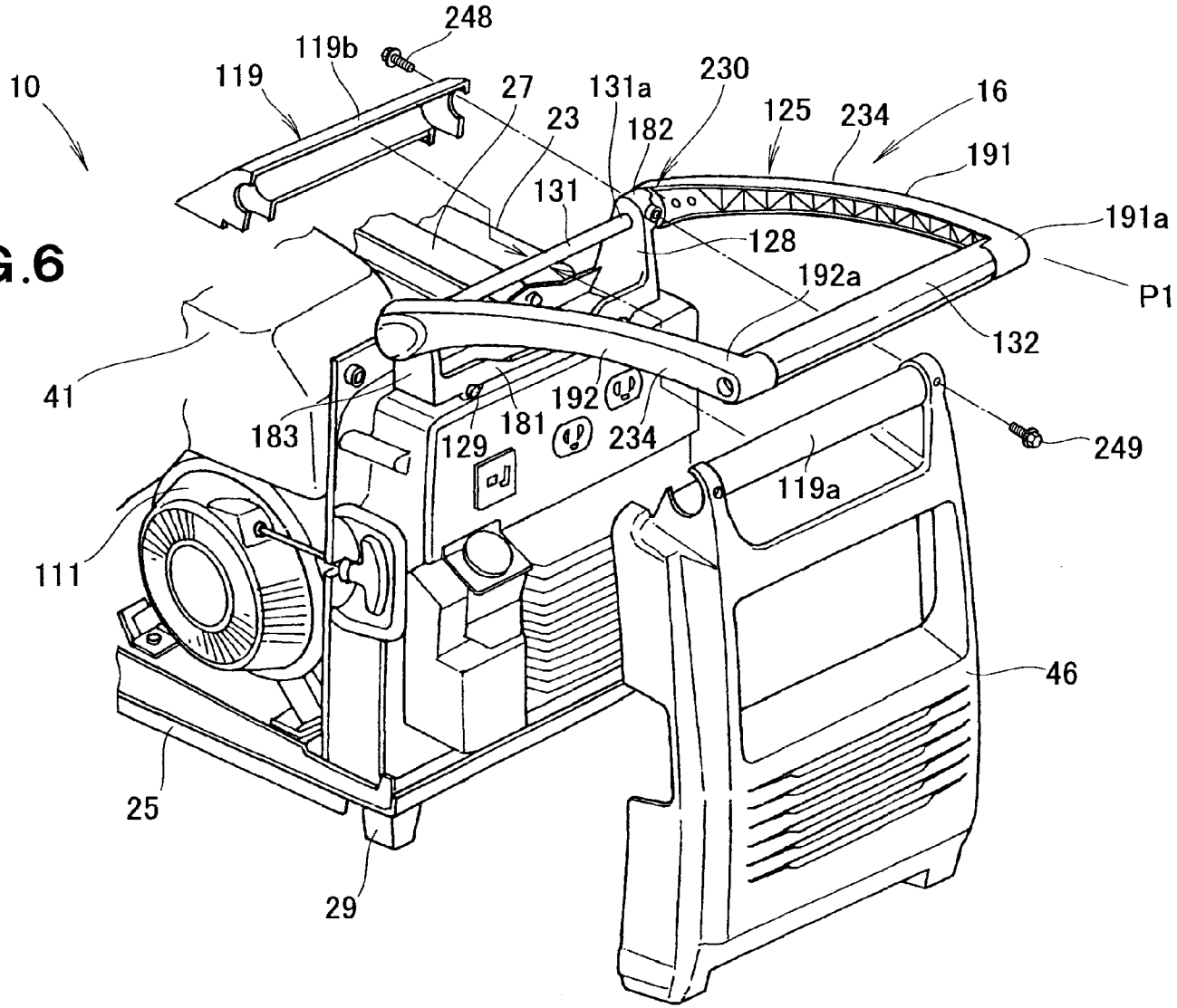
FIG. 6 is an exploded perspective view showing a front case section removed from the engine generator.

In FIGS. 5 and 6, the intake/fuel feed mechanism 14 feeds fuel mixed with air to the engine 21 (FIG. 4) of the engine/generator unit 12. The intake/fuel feed mechanism 14 is provided with a fuel tank 41 disposed above the generator 22, and a carburetor 101 provided to the cylinder block 35 (FIG. 2) of the engine 21.

The fuel tank 41 stores fuel to be fed to the engine 21.

The carburetor 101 mixes fuel brought from the fuel tank 41 with air brought from an air cleaner (not shown) and feeds the air-fuel mixture to the engine 21.

The fuel tank 41 and the carburetor 101 are disposed in an area to the left of the center frame 27 (insulating material 18), i.e., in a cool area 53 (FIG. 4). The engine 21 and the muffler 23 are disposed in an area to the right of the center frame 27 (insulating material 18); i.e., in a hot area 54, as shown in FIG. 4.

The skeletal member 11 is composed of the bottom cover 25 for supporting the engine/generator unit 12, the vertical frame 26 erectly disposed in the vicinity of the front-end part 25*a* of the bottom cover 25, and the center frame 27 that extends between an upper section center 26*a* of the vertical frame 26 and a rear end center section 25*e* of the bottom cover 25. The rear end center section 25*e* is a center section between the left and right wheels 31, 32 of the rear-end part 25*b*.

The engine/generator unit 12 in which the engine 21 and the generator 22 (FIG. 4) are integrally provided is mounted on the bottom cover 25 using four mounting members 33, as described above. A recoil starter 111 for starting the engine 21 is provided to the engine 21.

The insulating material 18 is provided to the center frame 27, as shown in FIG. 4. The insulating material 18 partitions the accommodation space 20 inside the case 17 into the cool area 53 and the hot area 54. The fuel tank 41 is provided above the generator 22.

The left and right wheels 31, 32 are rotatably mounted on the bottom cover 25 via the shaft 113. In other words, the wheel accommodation space 38 is provided below the cylinder block 35 in a state in which the cylinder block 35 of the engine 21 is inclined at an angle θ, as shown in FIG. 2. The space is used for forming the left and right wheel housings 115, 116 in the left and right corner sections 25*f*, 25*g* of the rear-end part 25*b* of the bottom cover 25.

The left and right wheel housings 115, 116 each bulge so as to curve upward. Providing the left and right wheel housings 115, 116 allows left and right recesses 115*a*, 116*a* that are capable of accommodating the left and right wheels 31, 32 to be formed below the left and right wheel housings 115, 116.

The left wheel 31 is disposed in the left recess 115*a* below the left wheel housing 115. Only the location 31*b* (FIG. 4) of the left wheel 31 in contact with the road surface 120 (see FIG. 4 as well) protrudes downward from the left recess 115*a*. The right wheel 32 is disposed in the right recess 116*a* below the right wheel housing 116. Only the location 32*b* (see FIG. 4 as well) of the right wheel 32 in contact with the road surface 120 protrudes downward from the right recess 116*a*. The bottom section of the engine generator 10 can thereby be lowered in a simple manner. The left and right wheel housings 115, 116 are symmetrically arranged. Therefore, the left and right recesses 115*a*, 116*a* are also symmetrically arranged.

The transport structure 16 is provided to the skeletal member 11. The transport structure 16 is provided with left and right wheels 31, 32 used for movement, a rear stationary handle (first stationary handle) 118 for lifting the rear side of the engine generator 10, a front stationary handle (second stationary handle) 119 for lifting the front side of the engine generator 10, and the draw handle 125 for pulling the engine generator 10.

The left and right wheels 31, 32 are provided to the rear-end part 25*b* of the bottom cover 25 via the shaft 113. The engine generator 10 can be moved by causing the left and right wheels 31, 32 to rotate in a state in which the left and right leg sections 29 are lifted from the road surface.

The rear stationary handle 118 is mounted on left and right handle support sections 121, 122 provided to the rear-end part 25*b* of the bottom cover 25. The left handle support section 121 is erectly provided to the left side section of the rear-end part 25*b*. The right handle support section 122 is erectly provided to the right side section of the rear-end part 25*b*. A left-end part 118*a* of the rear stationary handle 118 is secured by a bolt 123 to the left handle support section 121. A right-end part 118*b* of the rear stationary handle 118 is secured by a bolt 123 to the right handle support section 122.

The bottom cover 25 forms the skeletal member 11 in conjunction with the vertical frame 26 and the center frame 27. Accordingly, the bottom cover 25 can be made sufficiently rigid. The left and right handle support sections 121, 122 are provided to the bottom cover 25, and the rear stationary handle 118 is provided to the left and right handle support sections 121, 122. The rear stationary handle 118 is thereby securely mounted on the left and right handle support sections 121, 122.

In a state in which the rear stationary handle 118 is mounted on the left and right handle support sections 121, 122, the rear stationary handle 118 is provided above the left and right wheels 31, 32 and is provided parallel to the shaft 113. The rear stationary handle 118 is formed in a U-shape as viewed from above and is provided so as to protrude rearward from the case 17. Accordingly, the handle section 118*c* of the rear stationary handle 118 can be set apart from the rear case section 47 (FIG. 1) of the case 17. As a result, the handle section 118*c* can be readily grasped without the hand of the person making contact with the rear case section 47 of the case 17.

The rear stationary handle 118 is positioned in substantially the center in the height direction of the rear case section 47, as shown in FIG. 1. The reason for disposing the rear stationary handle 118 in substantially the center in the height direction of the rear case section 47 is described with respect to FIG. 17.

The draw handle 125 is provided with a support shaft 131 supported by left and right bracket parts 182, 183 of the handle support section 128, left and right pivot arms 191, 192 provided to the left and right ends, respectively, of the support shaft 131, a movable handle 132 that extends between distal end sections 191*a*, 192*a* of the left and right pivot arms 191, 192, and a positioning structure 230 for positioning the movable handle 132 in a transport position P1.

The handle support section 128 has a base section 181 that extends in the lateral direction, and the left and right bracket parts 182, 183 erectly provided from the left and right ends of the base section 181.

The base section 181 is fastened together with the center frame 27 using a plurality of bolts 129 in the upper section center 26*a* of the vertical frame 26.

Left and right support holes 182*a* (only left support hole 182*a* is shown in FIG. 8) are formed on the left and right bracket parts 182, 183, respectively. The support shaft 131 passes through the left and right support holes 182*a* and is supported by the left and right bracket parts 182, 183.

The upper section center 26*a* of the vertical frame 26 is positioned in a location 17*b* (FIG. 1) on the side where the upper section 17*a* (FIG. 1) of the case 17 is located and on the side opposite the left and right wheels 31, 32. Accordingly, the draw handle 125 is disposed in the location 17*b* on the side where the upper section 17*a* of the case 17 is located on the outside of the case 17 and the side opposite from the left and right wheels 31, 32. The draw handle 125 is swingably supported in the vertical direction on the upper section center 26*a* of the vertical frame 26 via the handle support section 128.

The vertical frame 26 is a member for forming the skeletal member 11 and has sufficient rigidity. Providing the draw handle 125 (movable handle 132) to the highly rigid vertical frame 26 allows the draw handle 125 to be securely mounted on the vertical frame 26.

Left and right ends 131*a*, 131*b* of the support shaft 131 are rotatably inserted into the support holes 182*a* (FIG. 8) of the left bracket part 182 and the right bracket part 183, respectively. The left and right bracket parts 182, 183 protrude upward. Accordingly, the support shaft 131 is positioned above the upper section 17*a* (FIG. 1) and protrudes further forward than the vertical frame 26. The support shaft 131 is coaxially provided inside the front stationary handle 119.

Figure 7:
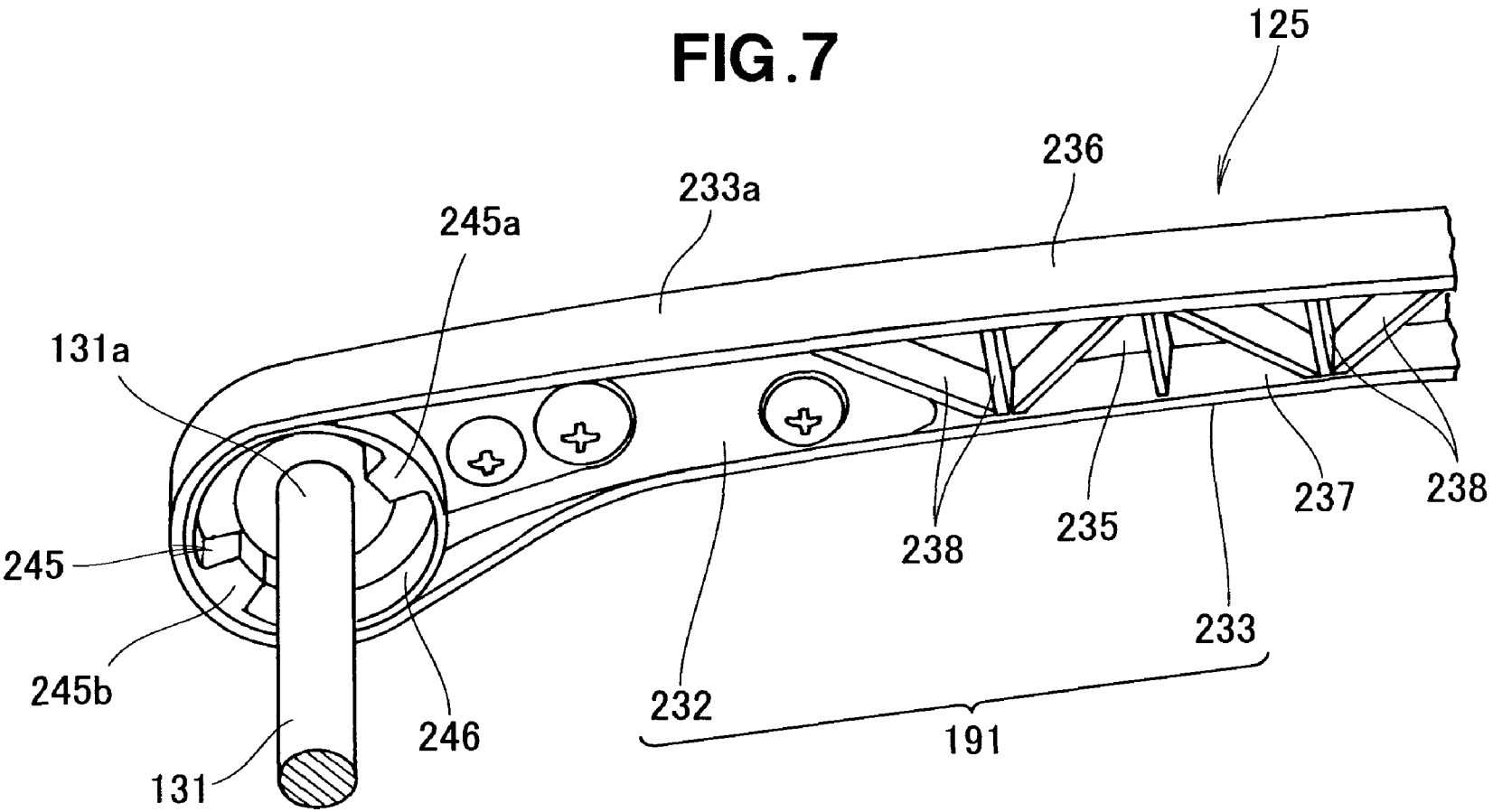
FIG. 7 is a perspective view showing the structure for positioning a left pivot arm and a draw handle of the engine generator of FIG. 1.

The left pivot arm 191 has a base part 232 provided to the left end 131*a* of the support shaft 131, and an arm body 233 having a base end part 233*a* connected to the base part 232, as shown in FIG. 7. The arm body 233 is provided so as to swing in the vertical direction about the support shaft 131.

The arm body 233 is formed by an outer wall 235, an upper wall 236, and a lower wall 237; and has a plurality of internally-disposed reinforcement ribs 238. The arm body 233 is formed from highly rigid fiber-reinforced plastic (FRP) and is U-shaped in cross section. Having the arm body 233 formed from fiber-reinforced plastic allows the thickness of the arm body 233 to be reduced, and the arm body 233 to be readily molded so as to be U-shaped in cross section. The weight of the arm body 233 is thereby reduced.

The right pivot arm 192 shown in FIG. 5 is symmetric to the left pivot arm 191. Accordingly, the right pivot arm 192 allows the weight of an arm body 234 thereof to be reduced in the same manner as the left pivot arm 191.

In other words, the movable handle 132 extends so as to be parallel to the support shaft 131 between the distal end 191a of the left pivot arm 191 (arm body 233) and the distal end 192*a* of the right pivot arm 192 (arm body 234), as shown in FIGS. 5 and 6.

The left and right ends 131*a*, 131*b* of the support shaft 131 are supported by the left bracket part 182 and the right bracket part 183, respectively. The left and right bracket parts 182, 183 are formed on the base section 181 of the handle support section 128. The handle support section 128 is mounted on the upper section center 26*a* of the vertical frame 26 using a plurality of bolts 129. Accordingly, the movable handle 132 is provided to the left and right pivot arms 191, 192 via the support shaft 131 and the handle support section 128. The movable handle 132 is formed from fiber-reinforced plastic (FRP).

As described above, the arm body 233 of the left pivot arm 191, the arm body 234 of the right pivot arm 192, and the movable handle 132 are formed from fiber-reinforced plastic. Accordingly, the arm main bodies 233, 234 and the movable handle 132 are reliably rigid, and the members can be made thinner. The arm body 233 of the left pivot arm 191 and the arm body 234 of the right pivot arm 192 can furthermore be formed so as to be U-shaped in cross section. As a result, the weight of the engine generator 10 can be reduced and the engine generator 10 can be more easily transported. The draw handle 125 is made easier to use, and reducing the weight of the arm main bodies 233, 234 and the movable handle 132 increases the level of convenience.

Figure 8A:
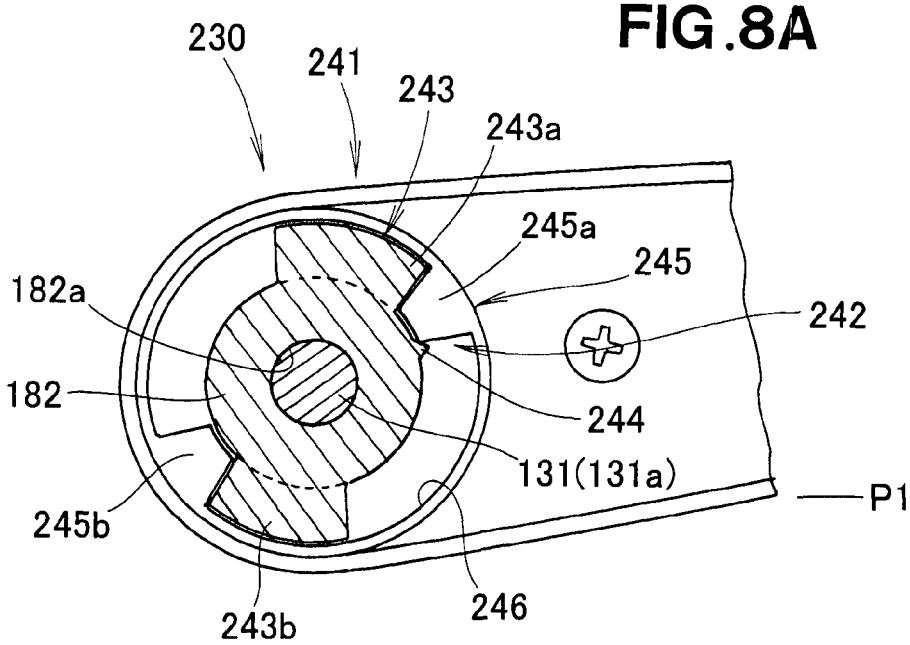
FIGS. 8A and 8B are cross-sectional views showing an operation of the structure for positioning the draw handle of FIG. 7.
Figure 8B:
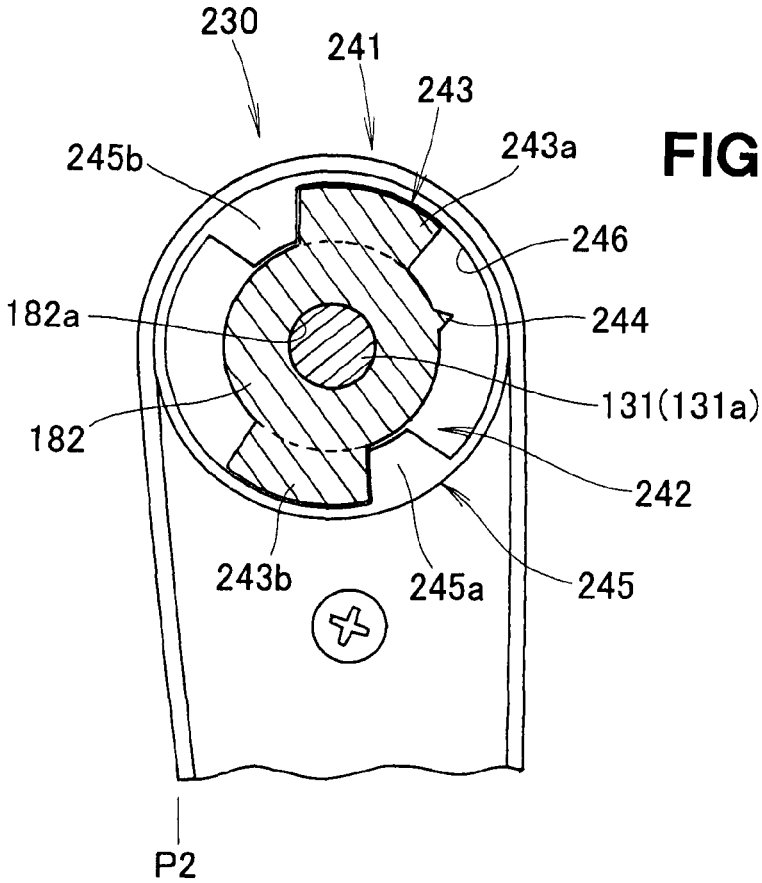

The positioning structure 230 constitutes means for positioning the movable handle 132 in the transport position P1 or the storage position P2, as shown in FIGS. 8A and 8B. The positioning structure 230 is provided with a restricting section 241 for positioning the movable handle 132 (FIG. 5) in the transport position P1 and a stopper section 242 that can make contact with the restricting section 241, the stopper section 242 being provided to the support shaft 131.

The restricting section 241 has a left restricting section 243 for positioning the movable handle 132 in the transport position P1 or the storage position P2, the left restricting section 243 being provided to the left bracket part 182; and a right restricting section (not shown) for positioning the movable handle 132 in the transport position P1 or the storage position P2, the right restricting section being provided to the right bracket part 183 (FIG. 5). The right restricting section is a member that is symmetric with the left restricting section 243. The description of the left restricting section 243 also applies to the right restricting section.

The left restricting section 243 has a pair of projections 243*a*, 243*b* that project outward in the radial direction from the external periphery of the left bracket part 182, and a holding pawl 244 that can elastically deform. The pair of projections 243*a*, 243*b* restricts the stopper section 242 to a predetermined position. The holding pawl 244 holds the stopper section 242 in the transport position P1.

The stopper section 242 has a left stopper section 245 that can make contact with the left restricting section 243, the left stopper section 245 being provided to the left end 131*a* of the support shaft 131; and a right stopper section (not shown) that can make contact with the right restricting section, the right stopper section being provided to the right end 131*b* (FIG. 5) of the support shaft 131.

The right stopper section is symmetric with the left stopper section 245. The description of the left stopper section 245 also applies to the right stopper section.

The left stopper section 245 has a recess 246 for rotatably supporting the left restricting section 243 on the base part 232 of the left pivot arm 191, and a pair of protruding pieces 245*a*, 245*b* that protrude from the internal peripheral wall of the recess 246 toward the center in the radial direction, as shown in FIG. 7.

According to the positioning structure 230, the protruding piece 245*a* is held by the holding pawl 244 in a state in which the protruding piece 245*a* is in contact with the projection 243*a* and the protruding piece 245*b* is in contact with the projection 243*b*, as shown in FIG. 8A. Accordingly, the movable handle 132 (FIG. 5) is kept in a state of being positioned in the transport position P1.

Figure 9:
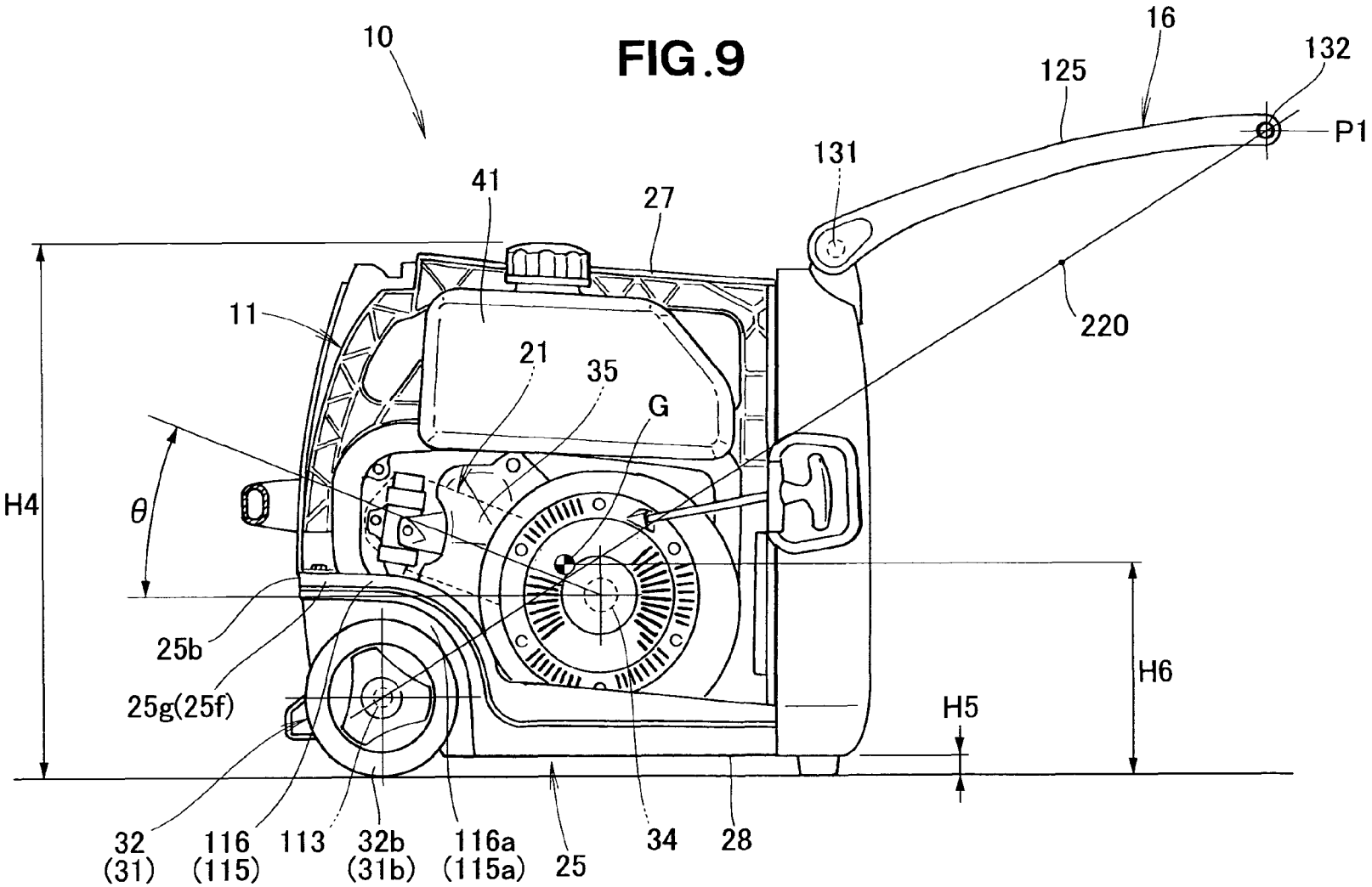
FIG. 9 is a side view showing a relationship between the draw position and the center of gravity position of the engine generator.

In the present embodiment, the transport position P1 of the movable handle 132 is set so as to satisfy the following conditions. The transport position P1 of the movable handle 132 is set so that the center of gravity G of the engine generator 10 is positioned in the vicinity of a line 220 that extends from the movable handle 132 to the left and right wheels 31, 32 (center of the left and right wheels 31, 32) in a state in which the movable handle 132 is positioned in the transport position P1, as shown in FIG. 9. The reason for this is described in FIGS. 9 to 11.

From this state, the holding pawl 244 is pressed by the protruding piece 245*a* and made to elastically deform by the movable handle 132 moving downward.

The protruding piece 245*a* rides over the holding pawl 244 and makes contact with the projection 243*b*, and the protruding piece 245*b* makes contact with the projection 243*a*, as shown in FIG. 8B. The movable handle 132 (FIG. 5) is positioned in the storage position P2.

As described above, the restricting section 241 and the stopper section 242 are provided as a positioning structure 230, the restricting section 241 is provided to the left and right bracket parts 182, 183 (FIG. 5), and the stopper section 242 is provided to the support shaft 131. The movable handle 132 is positioned in the transport position P1 when the stopper section 242 makes contact with the restricting section 241.

A high level of rigidity is attained because the left and right bracket parts 182, 183 support the support shaft 131.

Providing the restricting section 241 to the highly rigid left and right bracket parts 182, 183 allows the stopper section 242 to be reliably positioned by the restricting section 241 in the transport position P1 when the stopper section 242 makes contact with the restricting section 241. The movable handle 132 can thereby be reliably positioned in the transport position P1 and the leg sections 29 can be reliably lifted from the road surface using the movable handle 132. Therefore, the engine generator 10 can be easily transported.

With reference again to FIG. 6, the front stationary handle 119 is provided with a front-side handle section 119*a* constituting the front half section of the front stationary handle 119, and a rear-side handle section 119*b* constituting the rear half section of the front stationary handle 119. The front-side handle section 119*a* is integrally formed with the upper section of the front case section 46. The front-side handle section 119*a* has a left end and a right end that are mounted on the left bracket part 182 and the right bracket part 183 using bolts 249.

The rear-side handle section 119*b* has a left end and a right end that are mounted on the left bracket part 182 and the right bracket part 183 using bolts 248. The front stationary handle 119 is coaxially provided to the support shaft 131 of the draw handle 125 so as to cover the support shaft 131, as shown in FIG. 2. Accordingly, the front stationary handle 119 can be reinforced by the support shaft 131. The weight of the engine generator 10 can thereby be reduced further because the front stationary handle 119 is simplified without any loss in the rigidity of the front stationary handle 119.

The left and right bracket parts 182, 183 are formed on the base section 181 of the handle support section 128, as shown in FIG. 5. The handle support section 128 is mounted on the upper section center 26*a* of the vertical frame 26 using a plurality of bolts 129. Accordingly, the front stationary handle 119 is provided to the upper section center 26*a* of the vertical frame 26 via the handle support section 128.

The front stationary handle 119 is provided to the vertical frame 26. The vertical frame 26 is a member for forming the skeletal member 11 and is able to provide the skeletal member 11 with sufficient rigidity. Providing the front stationary handle 119 to the highly rigid vertical frame 26 enables the front stationary handle 119 to be securely mounted thereon.

Providing the front stationary handle 119 to the upper section center 26*a* of the vertical frame 26 via the handle support section 128 results in the front stationary handle 119, as shown in FIG. 1, being provided parallel to the shaft 113 (FIG. 2) at the location 17*b* on the upper section 17*a* side of the case 17 and on the side opposite the left and right wheels 31, 32. In other words, the front stationary handle 119 is disposed on the front side of the case 17 (the other side of the case 17 in the longitudinal direction) and on the upper side of the case 17. Accordingly, the front stationary handle 119 can be set apart from the location 17*b* (FIG. 1) on the upper section 17*a* side of the case 17 and on the side opposite from the left and right wheels 31, 32. A person can thereby easily grasp the front stationary handle 119 without having their hand make contact with the location 17*b* of the case 17.

According to the transport structure 16 described above, it is possible to swing the draw handle 125 upward about the support shaft 131 to the transport position P1, and grasp and pull the movable handle 132 of the draw handle 125. In other words, the left and right leg sections 29 can be lifted from the road surface 120 by grasping and lifting the movable handle 132. In this state, the left and right wheels 31, 32 can be made to rotate and the engine generator 10 can be moved by pulling the movable handle 132.

On the other hand, the draw handle 125 is swung to the storage position P2 (see FIG. 8B) about the support shaft 131, and held by the front case section 46 (FIG. 2). In this state, the rear stationary handle 118 and the front stationary handle 119 can be grasped and the engine generator 10 can be lifted and carried.

As shown in FIG. 9, the cylinder block 35 of the engine 21 of the engine generator 10 is disposed in a state inclined at an angle θ toward the left and right wheels 31, 32 (i.e., toward the shaft 113 for supporting the left and right wheels 31, 32) about the drive shaft 34. The height H1 of the engine 21 can be kept low (FIG. 2) and the height H4 of the engine generator 10 can be reduced by inclining the cylinder block 35 at the angle θ.

Adequate wheel accommodation space 38 (FIG. 2) can be provided below the cylinder block 35 in a state in which the cylinder block 35 is inclined at the angle θ. The space 38 is used for forming the left and right wheel housings 115, 116 in the left and right corner sections 25*f*, 25*g* of the rear-end part 25*b* of the bottom cover 25. Arranging the left and right wheels 31, 32 using the wheel accommodation space 38 allows the left and right wheels 31, 32 to be upwardly (in a high position) disposed. Accordingly, the bottom section of the engine generator 10; i.e., the height H5 of the bottom surface 28 of the bottom cover 25, can be kept low.

The left and right recesses 115*a*, 116*a* are formed below the left and right wheel housings 115, 116, respectively. The left wheel 31 is accommodated in the left recess 115*a*, and the right wheel 32 is accommodated in the right recess 116*a*, as shown in FIG. 5. Accordingly, only the location 31*b* of the left wheel 31 in contact with the road surface 120 (also see FIG. 4) is allowed to protrude downward from the left recess 115*a*. Similarly, only the location 32*b* of the right wheel 32 in contact with the road surface 120 (also see FIG. 4) is allowed to protrude downward from the right recess 116*a*. The bottom section of the engine generator 10; i.e., the height H5 of the bottom surface 28 of the bottom cover 25, can be lowered in a simple manner.

Keeping the height H4 of the engine generator 10 and the height H5 of the bottom surface 28 of the bottom cover 25 low thus allows the height position H6 of the center of gravity G of the engine generator 10 to be kept low.

The transport position P1 of the movable handle 132 is set so that the center of gravity G of the engine generator 10 is positioned in the vicinity of the extension line 220 in a state in which the movable handle 132 is positioned in the transport position P1. The extension line 220 extends straight from the center of the movable handle 132 to the center of the left and right wheels 31, 32.

Having the support shaft 131 of the draw handle 125 disposed above the case 17 allows the transport position P1 of the movable handle 132 to be disposed in a relatively high position. Accordingly, the extension line 220 can be disposed in a relatively high position, and can be disposed in the vicinity of the center of gravity G of the engine generator 10.

Having the transport position P1 disposed in a relatively high position allows the lifting distance to be reduced when the movable handle 132 is lifted from the transport position P1 to the actual transport position. Accordingly, the distance that the center of gravity G increases in height can be reduced when the engine generator 10 is transported. The engine generator 10 can thereby be transported in a stabilized state.

Figure 10:
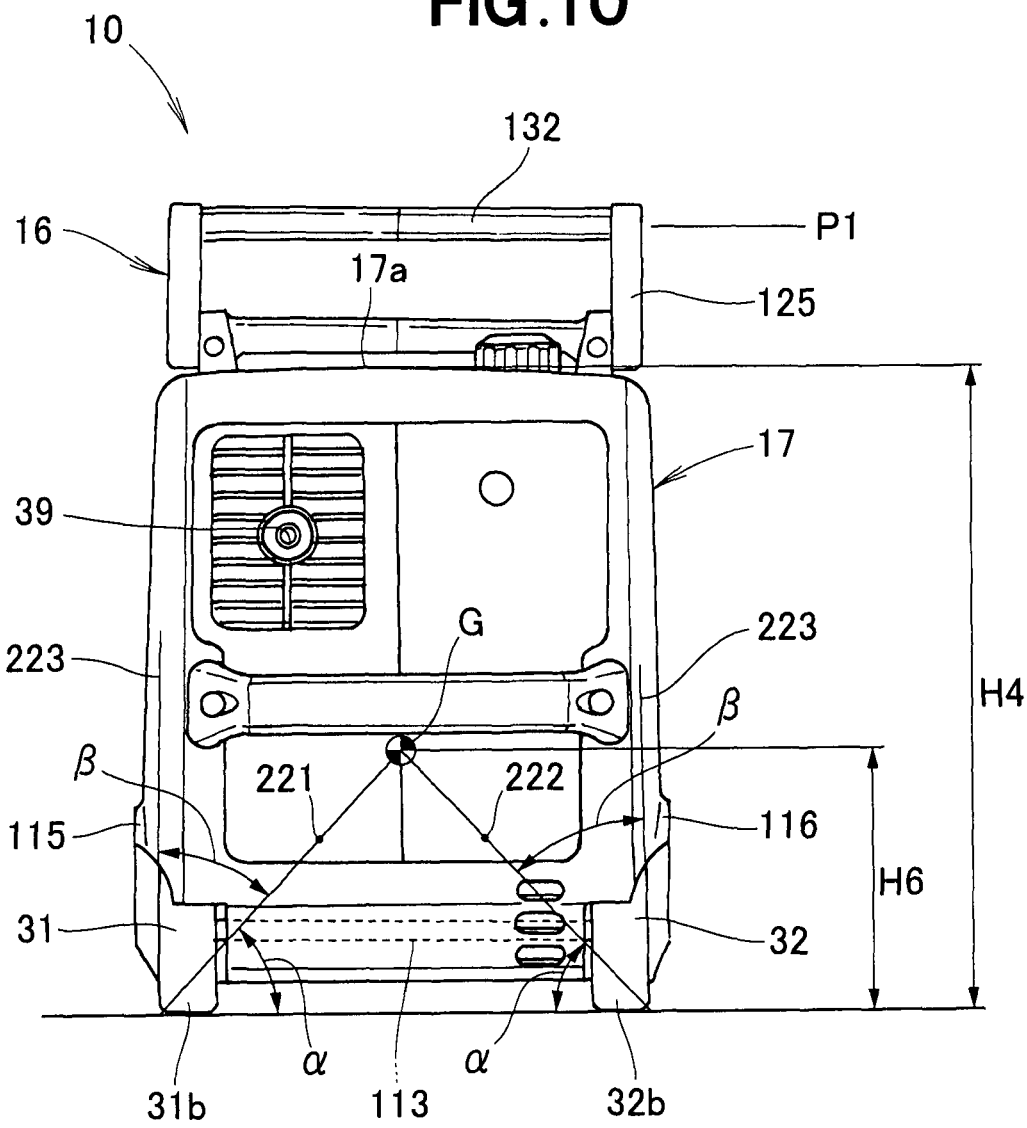
FIG. 10 is a rear view showing the center of gravity position of the engine generator.

Keeping the center of gravity of the engine 21 (FIG. 9) low without any movement in the lateral direction, as shown in FIG. 10, allows the center of gravity of the engine 21 to be positioned in substantially the center in the width direction of the engine generator 10. Accordingly, the height H6 is kept low and the center of gravity G of the engine generator 10 is positioned in substantially the center in the width direction of the engine generator 10.

The inclination angle α of a left-side inclination line 221 that connects the left wheel 31 and the center of gravity G of the engine generator 10 can be kept small by having the center of gravity G of the engine generator 10 disposed in substantially the center of width direction. Accordingly, the angle β of the left-side inclination line 221 with respect to a vertical line 223 can be kept large. The angle β is the maximum inclination angle in the case that the engine generator 10 tilts (topples) to the left side. The maximum inclination angle β can thereby be made adequately large for instances where the engine generator 10 tilts to the left side.

Similarly, the inclination angle α of a right-side inclination line 222 that connects the right wheel 32 and the center of gravity G of the engine generator 10 can be kept small. The maximum inclination angle β can thereby be made adequately large for instances where the engine generator 10 tilts to the right side.

Figure 11:
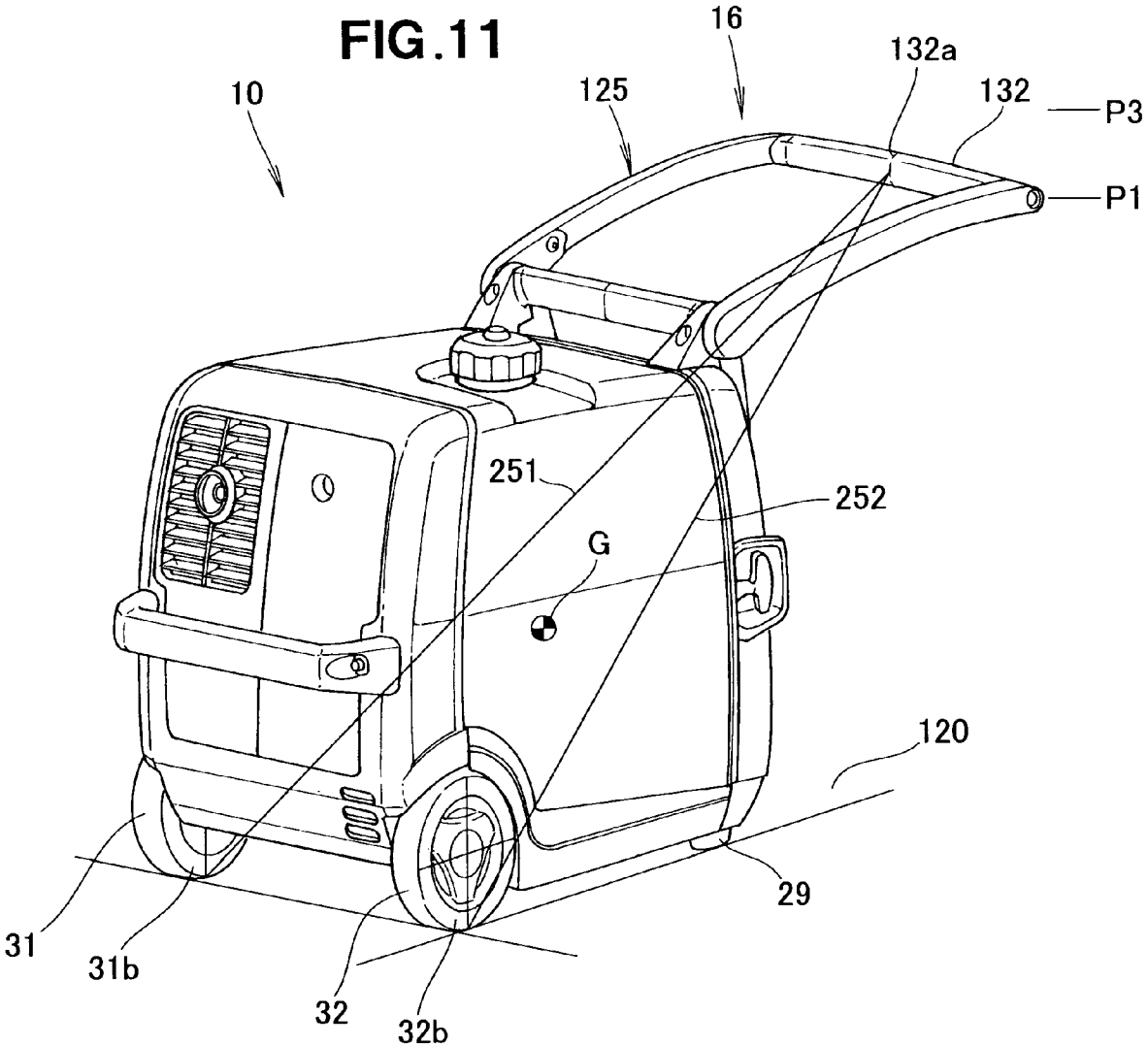
FIG. 11 is a perspective view showing the left and right tilt of the engine generator.

The draw handle 125 is positioned in the transport position P1, as shown in FIG. 11. Apart 132*a* substantially in the center of the movable handle 132 is grasped by the hand 226 of the person 225 (FIG. 12), the movable handle 132 is lifted to the actual transport position (position for actual transport) P3, and the left and right leg sections 29 are lifted from the road surface 120. In this state, the left and right wheels 31, 32 rotate and the engine generator 10 can be moved forward by pulling the movable handle 132 forward.

In the present embodiment, the engine generator 10 may tilt about the left or right tilt lines 251, 252 when the movable handle 132 is lifted and the engine generator 10 is transported over uneven ground or another irregular surface on the left and right wheels 31, 32.

The left tilt line 251 is a line that connects the part 132*a* substantially in the center of the movable handle 132 and the left wheel 31 (the location 31*b* in contact with the road surface 120).

The left tilt line 252 is a line that connects the part 132*a* substantially in the center of the movable handle 132 and the right wheel 32 (the location 32*b* in contact with the road surface 120).

The left tilt line 251 is positioned slightly lower than the extension line 220 shown in FIG. 9. Accordingly, the left tilt line 251 is positioned in the vicinity of the center of gravity G in the height direction. The engine generator 10 can be satisfactorily prevented from tilting or toppling about the left tilt line 251 when the engine generator 10 is transported over uneven ground or another irregular surface because the left tilt line 251 is positioned in the vicinity of the center of gravity G in the height direction.

The right tilt line 252 is symmetrical with the left tilt line 251. Accordingly, the right tilt line 252 is positioned in the vicinity of the center of gravity G in the height direction. The engine generator 10 can be satisfactorily prevented from tilting or toppling about the right tilt line 252 when the engine generator 10 is transported over uneven ground or another irregular surface because the right tilt line 252 is positioned in the vicinity of the center of gravity G in the height direction.

The engine generator 10 can thus be less likely to tilt to the left or right side than when the center of gravity G of the engine generator 10 is disposed above the left and right tilt lines 251, 252. This is because the center of gravity G of the engine generator 10 is positioned in the vicinity of the height direction of the left and right tilt lines 251, 252. The engine generator 10 can thereby be transported in a stabilized state even on uneven ground or another irregular surface and the engine generator 10 can be made easier to transport.

In the present embodiment, the left and right tilt lines 251, 252 can be positioned in the vicinity of the center of gravity G of the engine generator 10 and below the center of gravity G, above the center of gravity G, or on the center of gravity G, by adjusting the transport position P1 using the positioning structure 230 shown in FIG. 8.

The method for adjusting the transport position P1 using the positioning structure 230 may involve adjusting the transport position P1 by changing the position of the restricting section 241 (specifically, the projections 243*a*, 243*b*) shown in FIG. 8, for example.

Figure 12A:
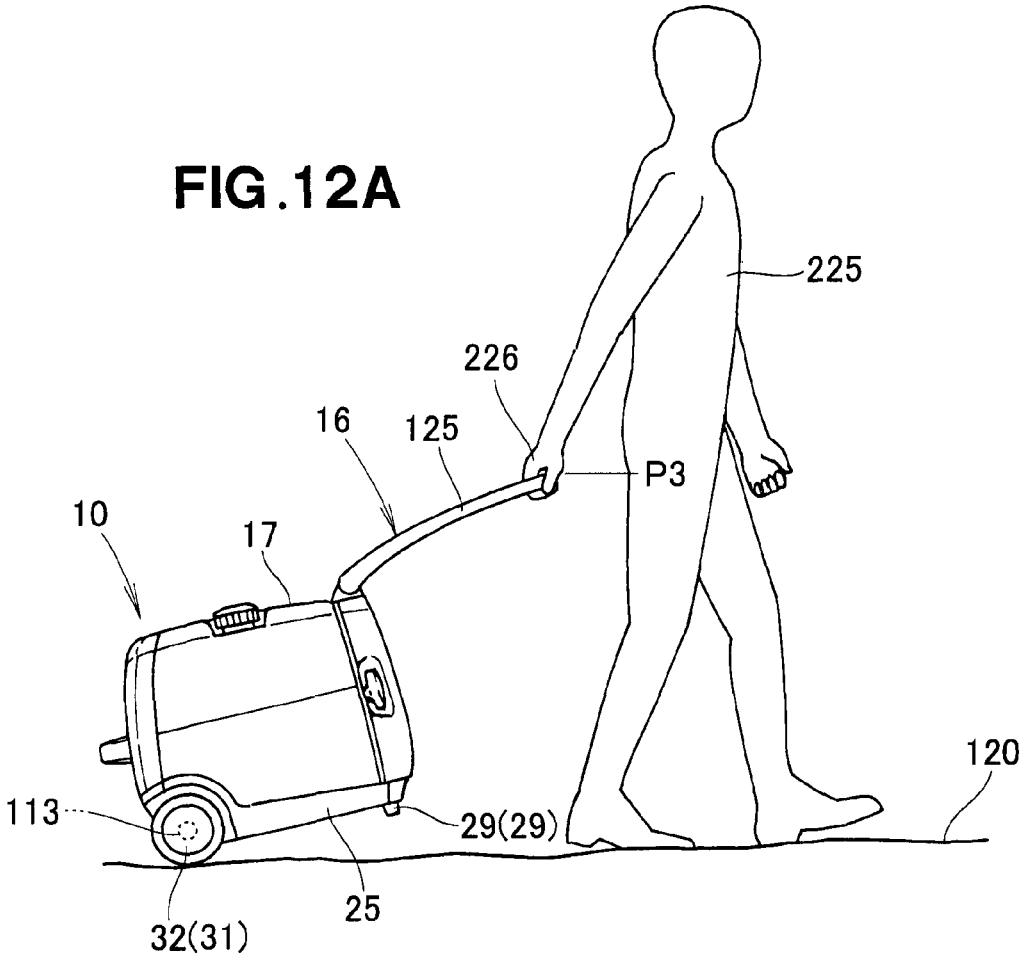
FIGS. 12A and 12B show examples of the movable handle of the draw handle being grasped using a single hand and the engine generator being moved.
Figure 12B:
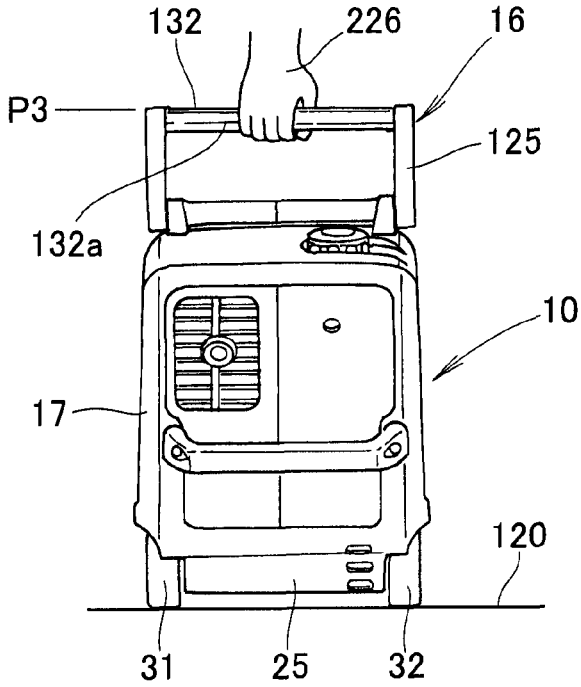

In FIGS. 12A and 12B, the draw handle 125 is disposed in the transport position P1 (FIG. 9), and the part 132*a* substantially in the center of the movable handle 132 is grasped by the hand 226 of the person 225. The movable handle 132 is lifted to the actual transport position P3 and the left and right leg sections 29 are lifted from the road surface 120.

Inclining the cylinder block 35 at an angle θ in the direction of the left and right wheels 31, 32 allows the center of gravity G of the engine generator 10 to be brought closer to the left and right wheels 31, 32, as shown in FIG. 2. The movable handle 132 is provided to the side where the leg sections 29 are located. Accordingly, the center of gravity G of the engine generator 10 can be set apart from the movable handle 132. The movable handle 132 can thereby be lifted to the actual transport position P3 with a relatively small amount of force.

The movable handle 132 is pivotably provided in the vertical direction to the support shaft 131 via the left and right pivot arms 191, 192, as shown in FIG. 5. Accordingly, the movable handle 132 can be disposed in a position set at a distance from the support shaft 131; i.e., a position set apart from the left and right wheels 31, 32. The lifting force of the movable handle 132 can thereby be reduced and transportability improved when the movable handle 132 is grasped by the hand 226 and the movable handle 132 is lifted about the shaft 113.

The movable handle 132 extends so as to be parallel to the support shaft 131 between the distal ends 191*a*, 192*a* of the left and right pivot arms 191, 192. Accordingly, it is possible for the person 225 to turn their back to the engine generator 10, grasp the movable handle 132 with a single hand 226, and lift the movable handle 132 to the actual transport position P3.

By grasping the movable handle 132 with one hand 226, the person 225 can stand away from the engine generator 10 without making contact therewith. This allows the person 225 to satisfactorily move the engine generator 10 while pulling the movable handle 132 with one hand 226.

Pulling the movable handle 132 in the forward direction in a state in which the movable handle 132 has been lifted to the actual transport position P3 allows the left and right wheels 31, 32 to rotate and the engine generator 10 to be transported in the forward direction.

Figure 13:
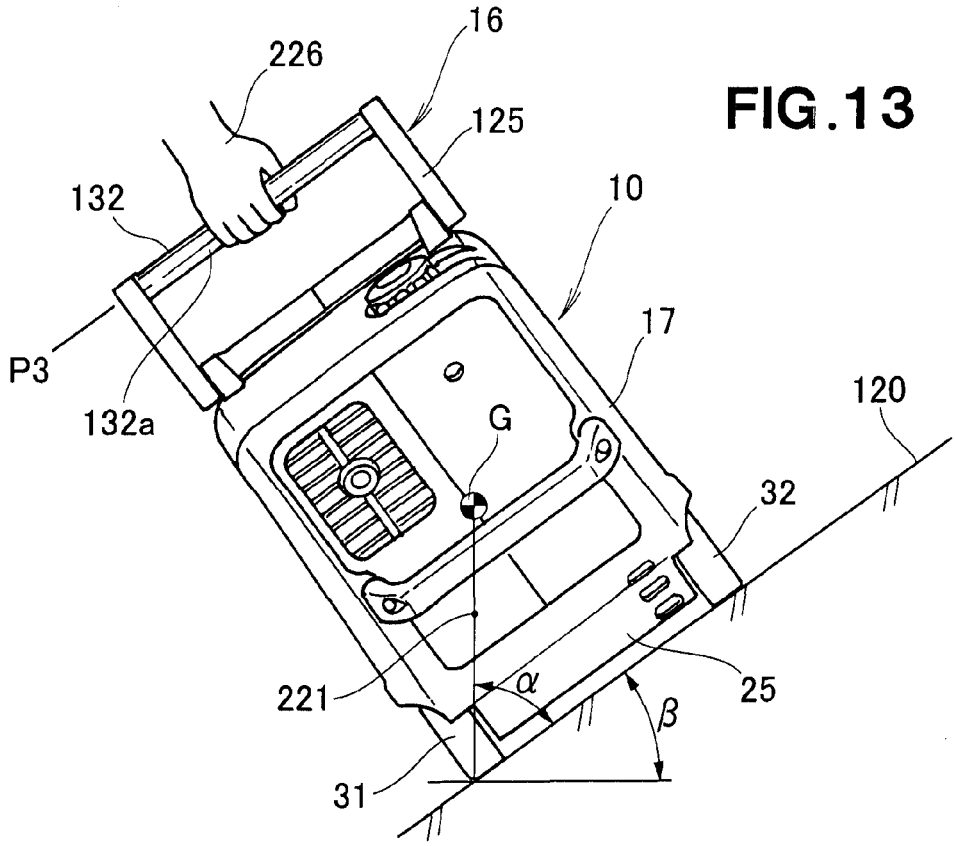
FIG. 13 shows the stability in the left and right directions as the engine generator is pulled.

FIG. 13 shows the state in which the engine generator is transported over uneven ground or another irregular surface.

The inclination angle α of the left-side inclination line 221 connecting the left wheel 31 and the center of gravity G of the engine generator 10 is kept small. Accordingly, a large maximum inclination angle β of the engine generator 10 is provided. The engine generator 10 is thereby less likely to tilt to the left side when transported over uneven ground or another irregular surface.

The inclination angle α of the right-side inclination line 222 connecting the right wheel 32 and the center of gravity G of the engine generator 10 is also kept small in the same manner as the left-side inclination line 221, as shown in FIG. 10. The engine generator 10 is thereby less likely to tilt to the right side when transported over uneven ground or another irregular surface.

The engine generator 10 can thus be kept in a stabilized orientation and made simpler to transport because the engine generator 10 can be made less liable to tilt in the left and right directions.

The person 225 grasps the draw handle 125 positioned in the transport position P1 (FIG. 9) with both hands 226 at substantially the center part 132*a* (FIG. 13) of the movable handle 132 in a state in which the person is facing the engine generator 10, as shown in FIG. 14. The person lifts the movable handle 132 to the actual transport position P3, and lifts the left and right leg sections 29 from the road surface 120.

The center of gravity G of the engine generator 10 is brought closer in the direction of the left and right wheels 31, 32 by inclining the cylinder block 35 at an angle θ in the direction of the left and right wheels 31, 32, as shown in FIG. 2. The movable handle 132 is provided to the side on which the leg sections 29 are located, which is the side opposite from that of the left and right wheels 31, 32. Accordingly, the center of gravity G of the engine generator 10 can be set apart from the movable handle 132. As a result, the movable handle 132 can be lifted to the actual transport position P3 with relatively little force. Pushing the movable handle 132 in the rearward direction in a state in which the movable handle 132 is lifted to the actual transport position P3 with relatively little force allows the left and right wheels 31, 32 to rotate and the engine generator 10 to be moved rearward.

The draw handle 125 is positioned in the storage position P2 and the front stationary handle 119 (see FIG. 1 as well) is grasped by the hand 226 of the person 225, as shown in FIG. 15. The front stationary handle 119 is lifted to an actual transport position P4 and the left and right leg sections 29 are moved away from the road surface 120.

The center of gravity G of the engine generator 10 is brought closer in the direction of the left and right wheels 31, 32 by inclining the cylinder block 35 at an angle θ toward the left and right wheels 31, 32, as shown in FIG. 2. The front stationary handle 119 is provided to the side on which the left and right leg sections 29 are located. Accordingly, the center of gravity G of the engine generator 10 can be set apart from the front stationary handle 119. As a result, the front stationary handle 119 can be lifted to the actual transport position P4 with relatively little force. Pushing the front stationary handle 119 in the rearward direction in a state in which the movable handle 132 is lifted to the actual transport position P4 with relatively little force allows the left and right wheels 31, 32 to rotate and the engine generator 10 to be transported in the rearward direction.

Causing the left and right wheels 31, 32 to rotate and transporting the engine generator 10 makes it possible, e.g., to position the engine generator 10 in a highly accurate manner. As a result, the engine generator 10 can be readily fit in a storage position when stored.

Reference is now made to FIG. 16 showing an example of two people transporting the engine generator.

The rear stationary handle 118 is provided to the rear section of the case 17. The front stationary handle 119 is provided to the front section of the case 17 and to the upper section of the case 17. Accordingly, a large distance L can be maintained between the rear stationary handle 118 and the front stationary handle 119. The rear stationary handle 118 is grasped by the hand 226 of a single person 225 in a state in which the draw handle 125 has swung to the storage position P2, and even when the front stationary handle 119 is grasped by the hand 228 of another person 227, the two people 225, 227 do not make contact with each other. Therefore, the engine generator 10 can be lifted and transported by two people 225, 227, and made easier to transport.

Figure 17A:
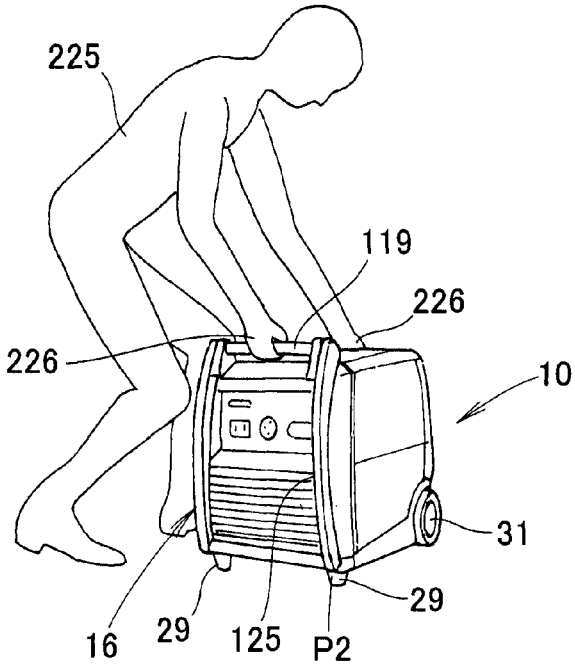
FIGS. 17A and 17B show an example of a single person lifting and causing the engine generator to ride on the wheels.
Figure 17B:
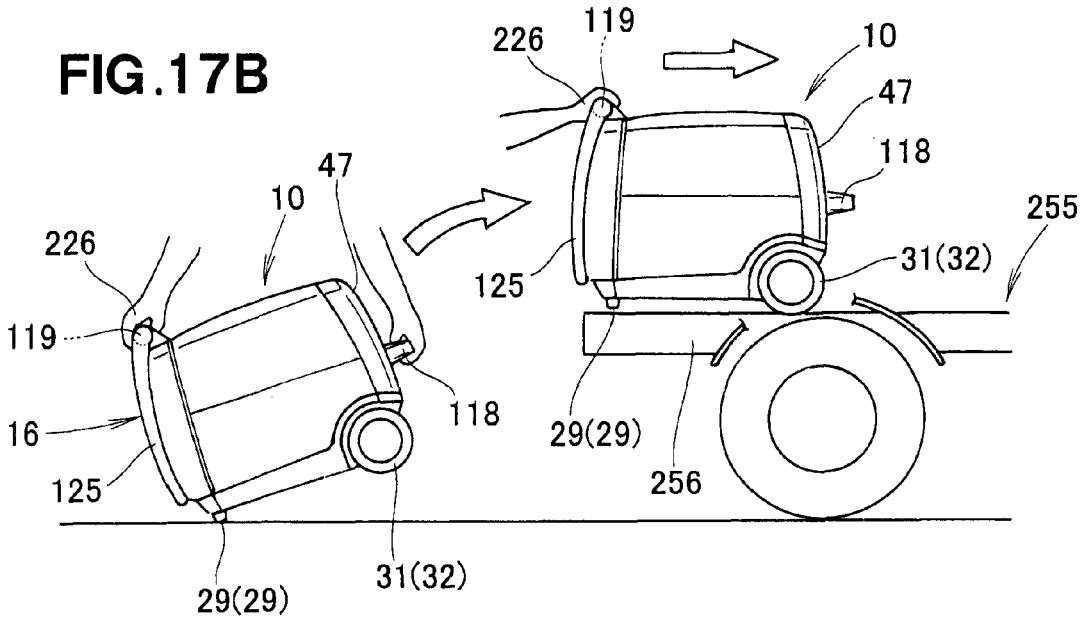

FIGS. 17A and 17B show an example in which the engine generator is loaded onto a vehicle.

In FIG. 17A, the rear stationary handle 118 (FIG. 17B) is grasped by the left hand 226 of the person 225 and the front stationary handle 119 is grasped by the right hand 226 of the person 225 in a state in which the draw handle 125 is folded in the storage position P2. In this state, the engine generator 10 is lifted by a single person 225.

In FIG. 17B, the rear stationary handle 118 is positioned in substantially the center in the height direction of the rear case section 47. In other words, the rear stationary handle 118 is disposed in a position lower than the front stationary handle 119. Accordingly, the lifting height of the rear stationary handle 118 can be kept low when the left and right wheels 31, 32 are loaded onto a cargo platform 256 of a vehicle 255. The front stationary handle 119 is pushed in a state in which the left and right wheels 31, 32 roll on the cargo platform 256, and the engine generator 10 can be readily arranged in a predetermined position thereon.

The movable handle 132, the rear stationary handle 118, and the front stationary handle 119 can be suitably selected and used when the engine generator 10 is to be transported, as described with reference to FIGS. 12 to 17. Various transport methods can thereby be selected, and the engine generator 10 is able to be transported in a simpler manner.

The skeletal member 11, the case 17, the bottom cover 25, the vertical frame 26, the center frame 27, the left and right leg sections 29, the rear stationary handle 118, the front stationary handle 119, the left handle support section 121, the right handle support section 122, the draw handle 125, the movable handle 132, the left bracket part 182, the right bracket part 183, the left pivot arm 191, the right pivot arm 192, the positioning structure 230, the restricting section 241, the stopper section 242, and the like shown in the embodiment are not limited to the depicted shapes, and may be suitably modified.

The present invention is advantageously applied to a wheeled engine generator that accommodates an engine and a generator inside a case.

Obviously, various minor changes and modifications of the present invention are possible in light of the above teaching. It is therefore to be understood that within the scope of the appended claims the invention may be practiced otherwise than as specifically described.

What is claimed is:

1. An engine generator comprising:

a bottom cover provided with left and right wheels via a shaft;

an engine disposed on the bottom cover;

a generator disposed on the bottom cover and driven by the engine;

a case for, jointly with the bottom cover, accommodating the engine and the generator;

a first stationary handle provided above the left and right wheels on one side in a front-and-rear direction of the case and extending parallel to the shaft;

a second stationary handle provided on an opposite side in the front-and-rear direction of the case and extending parallel to the shaft; and a draw handle provided externally of the case in such a manner as to be vertically swingable relative to the second stationary handle, wherein the draw handle includes a support shaft coaxially provided inside the second stationary handle, left and right pivot arms vertically swingably provided on the support shaft, and a movable handle provided extending between the left and right pivot arms.

2. The engine generator of claim 1, further comprising a skeletal member which in turn comprises the bottom cover, a wall-shaped vertical frame, and a center frame, the vertical frame rising from a vicinity of an end part of the bottom cover on a side remote from the left and right wheels, the center frame extending between the vertical frame and an end part of the bottom cover on a side where the left and right wheels are provided, the first stationary handle being mounted via left and right handle mounting sections provided on the bottom cover, the second stationary handle being mounted on the vertical frame.

3. The engine generator of claim 1, wherein the draw handle further comprises a structure for positioning the movable handle in a transport position, and the positioning structure positions the movable handle such that a center of gravity of the engine generator is positioned in a vicinity of tilt lines that respectively extend from the movable handle to the left and right wheels.

4. The engine generator of claim 1, wherein the second stationary handle covers the support shaft and is coaxial with the support shaft.

5. The engine generator of claim 1, wherein the bottom cover includes leg sections on two corner sections located oppositely from corner sections where the left and right wheels are provided.

6. The engine generator of claim 3, wherein the positioning structure comprises: a restricting section for positioning the movable handle in a transport position, the restricting section being provided at a location for supporting the support shaft; and a stopper section provided on the support shaft and being capable of making contact with the restricting section, wherein the movable handle is positioned into the transport position by the stopper section making contact with the restricting section.

7. The engine generator of claim 1, wherein the left and right pivot arms and the movable handle are formed from fiber-reinforced plastic.

* * * * *